US006597878B2

(12) United States Patent
Nakazato et al.

(10) Patent No.: US 6,597,878 B2
(45) Date of Patent: Jul. 22, 2003

(54) APPARATUS FOR MEASURING QUANTITY OF TONER, AND IMAGE FORMING APPARATUS COMPRISING MEASURING APPARATUS

(75) Inventors: Hiroshi Nakazato, Suwa (JP); Takashi Hama, Suwa (JP); Yoshio Nakazawa, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 42 days.

(21) Appl. No.: 09/962,154

(22) Filed: Sep. 26, 2001

(65) Prior Publication Data

US 2002/0041770 A1 Apr. 11, 2002

(30) Foreign Application Priority Data

Sep. 29, 2000 (JP) ..... 2000-298905
Oct. 5, 2000 (JP) ..... 2000-306331

(51) Int. Cl.[7] ..... G03G 15/00
(52) U.S. Cl. ..... 399/49
(58) Field of Search ..... 399/49, 27

(56) References Cited

U.S. PATENT DOCUMENTS 5,697,011 A * 12/1997 Kobayashi et al. ..... 399/49

FOREIGN PATENT DOCUMENTS

| | | | |
|---|---|---|---|
| JP | 6-250480 | * | 9/1994 |
| JP | 7-172635 | * | 7/1995 |
| JP | 8-219990 | * | 8/1996 |
| JP | 10-63058 | | 3/1998 |
| JP | 10-186827 | | 7/1998 |
| JP | 10-221902 | * | 8/1998 |
| JP | 2000-29271 | | 1/2000 |
| JP | 2000-298065 | * | 10/2000 |

* cited by examiner

*Primary Examiner*—Fred L. Braun
(74) *Attorney, Agent, or Firm*—Oblon, Spivak, McClelland, Maier & Neustadt, P.C.

(57) ABSTRACT

A toner quantity measuring apparatus in which an input offset voltage is applied to the output side of an irradiation quantity monitoring light receiving element, so that a light emitting element remains turned off unless a light quantity control signal exceeds a predetermined signal level. Prior to irradiation of light upon an intermediate transfer belt and measurement of a toner quantity, a light quantity control signal below the predetermined signal level is supplied to an irradiation quantity adjusting unit and the light emitting element is turned off without fail. A memory stores, as a dark output voltage, an output voltage from a reflection quantity detecting unit upon the turning off. Light reflected from the intermediate transfer belt is split into p-polarized and s-polarized light to detect a toner quantity and colors of the toner. In actual measurement of the toner quantity, with light irradiated upon the intermediate transfer belt, the dark output voltage is subtracted from the output voltage outputted from the reflection quantity detecting unit, whereby an influence of the dark output voltage is eliminated.

21 Claims, 17 Drawing Sheets

APPARATUS FOR MEASURING QUANTITY OF TONER, AND IMAGE FORMING APPARATUS COMPRISING MEASURING APPARATUS

BACKGROUND OF THE INVENTION

1. Field of the Invention

The present invention relates to a toner quantity measuring apparatus which measures the quantity of toner adhering to an image carrier such as a photosensitive member and a transfer medium, and an image forming apparatus which comprises such a toner quantity measuring apparatus.

2. Description of the Related Art

For the purpose of realizing a stable image density, an image forming apparatus of the electrophotographic type, such as a printer, a copier machine and a facsimile machine, internally comprises a toner quantity measuring apparatus which measures the quantity of toner adhering to an image carrier such as a photosensitive member and a transfer medium. Such a toner quantity measuring apparatus is as described in Japanese Patent Application Unexamined Gazette No. 2000-29271, for example. A toner quantity measuring apparatus described in this gazette (hereinafter "first conventional apparatus") has a light emitting element irradiating light toward an image carrier such as a photosensitive member and a reflection-side light receiving unit including a light receiving element. The light receiving element receives reflected light from the photosensitive member so that the quantity of toner on the photosensitive member is calculated based on the quantity of the received light (the quantity of the reflected light).

Further, aiming at stabilization of the quantity of the irradiated light, a beam splitter splits the irradiated light at a predetermined ratio, whereby the irradiated light is partially extracted. Another light receiving element (of irradiation-side light receiving unit) detects the quantity of the extracted light, and the light emitting element is feedback-controlled in such a manner that the detection result stays at a reference value.

Meanwhile, often used as a light receiving element is as shown in FIG. 1, for instance. FIG. 1 is a drawing of an electric structure of a conventional light receiving unit. In this light receiving unit, an anode terminal of a light receiving element PS, such as a photodiode, is connected with a ground potential and a non-inversion input terminal of an operational amplifier OP which forms a current-voltage (I/V) conversion circuit. A cathode terminal of the light receiving element PS is connected with the non-inversion input terminal of the operational amplifier OP, and additionally, with an output terminal of the operational amplifier OP through a resistor R. Hence, as the light receiving element PS receives light and carries a photoelectric current i, an output voltage V0 at the output terminal of the operational amplifier OP is:

$$V0=i\cdot R$$

Thus, the light receiving unit outputs a signal corresponding to the quantity of the reflected light.

In the light receiving unit having such a structure, since the level of the output signal, e.g., an output voltage, from the light receiving unit changes approximately in proportion to the quantity of incident light which is the quantity of the reflected light from a photosensitive member, the circuitry of the light receiving unit is normally configured such that a detection signal having a characteristic as that denoted at the solid line in FIG. 2 is obtained. However, depending on irregularity among light receiving units or other circuit elements, a change in characteristics due to an environmental condition, a change in characteristics due to deteriorated durability, etc., a characteristic as that denoted at the dotted line or the dotted-and-dashed line in FIG. 2 may be realized.

Now, a characteristic as that denoted at the dotted-and-dashed line in FIG. 2 will be considered. Assuming that the circuit shown in FIG. 1 is operated by a dual power supply which uses a (+15V)-power source and a (−15V)-power source, a negative voltage is outputted when the quantity of the reflected light is zero. However, as a dual power supply requires a higher cost for a power source part, a single power supply with only a (+15V)-power source is often used in an actual apparatus. Yet, if only one power source is used, as indicated by the characteristic at the dotted-and-dashed line in FIG. 2, a so-called dead zone where the output voltage level remains at zero without any change will be developed. This in other words is a problem that such a toner quantity which produces only a small amount of reflected light can not be measured. This problem worsens particularly when high-density black toner is to be detected, since black toner absorbs light and the amount of reflected light therefore sharply decreases.

Noting this, another option for measurement of a toner quantity on the high-density side may be to increase the quantity of the irradiated light from the light emitting element, and hence, the quantity of the reflected light. However, this merely shifts the problematic zone but fails to completely solve the problem since a similar problem will rise during measurement of the quantity of toner having an even higher density. Further, in the case of the first conventional apparatus, it is possible to set the quantity of the irradiated light from the light emitting element only at one single light quantity. Hence, a toner quantity can be accurately measured only within a limited density range in the first conventional apparatus.

On the other hand, a characteristic as that denoted at the dotted line in FIG. 2 leads to a situation that an output does not become zero even if the light emitting element is not irradiating light, which is known as outputting of a dark output. Due to this, even when the light emitting element irradiates light upon the photosensitive member and the quantity of the reflected light from the photosensitive member is detected, the detection result contains a dark output component. Adding to the difficulty, the dark output is relevant to characteristics such as a dark current of the light receiving unit and an offset of the operational amplifier, and therefore, changes in accordance with an environmental condition, such as a temperature around the apparatus, and a change with time of the components which form the apparatus. Thus, highly accurate measurement of a toner quantity is difficult.

A conventional approach to these problems is to suppress the irregularity using an adjustment circuit which is disposed inside the apparatus. However, such a structure has been met with a challenge that the light receiving unit has a complex circuit, a higher cost is required as repeated adjustment is necessary and even more highly accurate measurement is difficult because of other factors such as uneven adjustment.

In a different toner quantity measuring apparatus described in the gazette above (hereinafter "second conventional apparatus"), a light emitting element irradiates light toward a photosensitive member (image carrier), light reflected at the photosensitive member is split into p-polarized light and s-polarized light, and a p-polarized light receiving unit detects the quantity of the p-polarized light while an s-polarized light receiving unit detects the quantity of the s-polarized light. The quantity of toner on the photosensitive member is found based on a difference between these two light quantities.

In the second conventional apparatus, units as that shown in FIG. 1 are used as the light receiving units, which results in similar problems to those with the first conventional apparatus described above. Further, measuring the quantity of the toner based on the difference between the two light quantities, the second conventional apparatus has another problem as described below. Owing to an environmental factor such as an ambient temperature and humidity, a change with time of the light emitting element, etc., the quantity of irradiated light upon the photosensitive member, a transfer image carrier or the like may sometimes change, and therefore, a toner quantity is wrongly detected because of the change in the quantity of irradiated light. For instance, as the quantity of irradiated light upon an image carrier such as the photosensitive member decreases, the quantities of the p-polarized light and the s-polarized light as well decrease, thereby changing the light quantity difference. As a result, a toner quantity calculated based on the difference as well changes, which worsens a measurement accuracy.

In addition, while color toner and black toner adhere to an image carrier such as a photosensitive member and a transfer medium in a color image forming apparatus, color toner and black toner have different reflection characteristics from each other. Thus, for measurement of the quantity of toner based on the quantity of reflected light, a toner quantity should be measured optimally for each toner color. Despite this, merely one type of toner quantity measurement is executed according to the first and the second conventional techniques, leaving enough room for improvement in measurement accuracy.

SUMMARY OF THE INVENTION

A principal object of the present invention is to provide a toner quantity measuring apparatus which allows highly accurate measurement of the quantity of toner which adheres on an image carrier such as a photosensitive member and a transfer medium.

Another object of the present invention is to provide an image forming apparatus which creates an image with a stable density based on a result of measurement obtained by the toner quantity measuring apparatus.

In fulfillment of the foregoing object, a predetermined output offset is applied to the output from a light receiving element. Toner quantity calculating means calculates the quantity of toner which adheres to an image carrier based on the output from the light receiving element. In this manner, with application of the output offset, it is possible to eliminate an influence of a dead zone without fail and output an output which corresponds to the quantity of the reflected light.

According to another aspect of the present invention, irradiation amount adjusting means keeps a light emitting element turned off while a light quantity control signal to control the quantity of light irradiated by the light emitting element remains below a predetermined input offset. This allows to turn the light emitting element off without fail.

According to further aspect of the present invention, reflection quantity detecting means detects light quantities of a first and a second light components which are different from each other and contained in reflected light from an image carrier, and toner quantity calculating means calculates a light quantity ratio between the light quantity of the first light component and the light quantity of the second light component which are detected by the reflection quantity detecting means, and calculates the quantity of toner adhering on the image carrier based on the light quantity ratio.

According to still another aspect of the present invention, toner quantity calculating means is structured so as to be able to execute, as a measurement process of measuring a toner quantity, a plurality of toner quantity detection processes which are different from each other, and selectively executes one of the plurality of toner quantity detection processes in accordance with the color of toner adhering on the image carrier.

The above and further objects and novel features of the invention will more fully appear from the following detailed description when the same is read in connection with the accompanying drawing. It is to be expressly understood, however, that the drawing is for purpose of illustration only and is not intended as a definition of the limits of the invention.

DETAILED DESCRIPTION OF THE PREFERRED EMBODIMENTS

Figure 3:
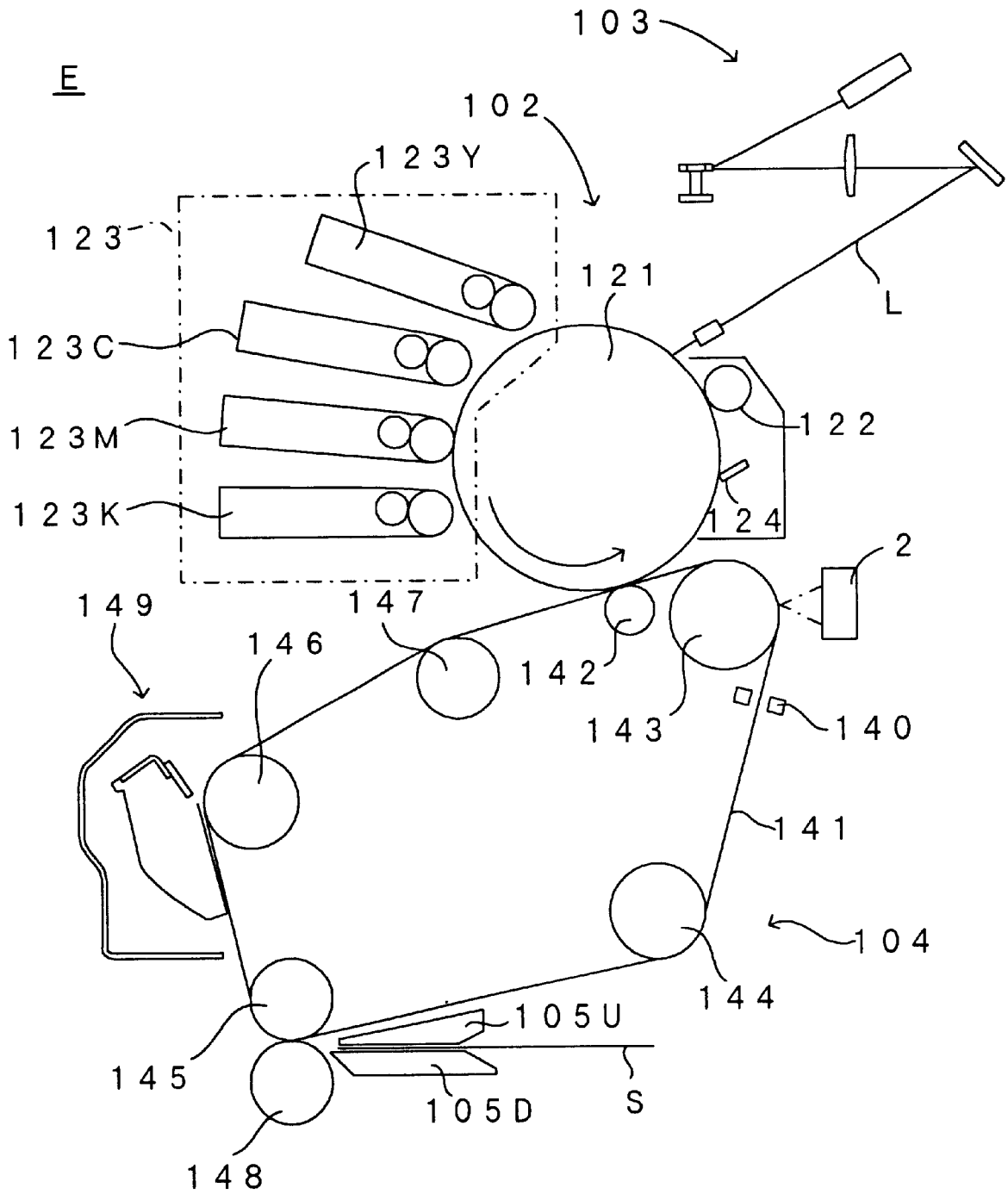
FIG. 3 is a drawing of a preferred embodiment of an image forming apparatus according to the present invention.

FIG. 3 is a drawing of a preferred embodiment of an image forming apparatus according to the present invention. This image forming apparatus is an apparatus which overlays toner in four colors of yellow (Y), cyan (C), magenta (M) and black (K) one atop the other and creates a full-color image. As a control unit (denoted generally at 6 in FIG. 4) receives an image signal from an external apparatus such as a host computer, an image corresponding to the image signal is created on a sheet S, such as a transfer paper, a copier paper and a transparency for an overhead projector, with the respective portions of an engine part E operating under the control of the control unit.

In the engine part E, it is possible to form a toner image on a photosensitive member 121 of a process unit 102. In other words, the process unit 102 comprises the photosensitive member 121 which can rotate in the direction indicated by the arrow in FIG. 3. Further, an electrifying roller 122 serving as electrifying means, developers 123Y, 123C, 123M and 123K serving as developing means, and a cleaner blade 124 for the photosensitive member are disposed around the photosensitive member 121 and along the direction of rotations of the photosensitive member 121.

In this apparatus, after the electrifying roller 122 uniformly electrifies an external circumferential surface of the photosensitive member 121 while staying in contact with the outer circumferential surface of the photosensitive member 121, an exposure unit 103 irradiates laser light L toward the outer circumferential surface of the photosensitive member 121 to form an electrostatic latent image thereon.

The electrostatic latent image thus created is developed with toner by a developer part 123. In short, the developer 123Y for yellow, the developer 123C for cyan, the developer 123M for magenta and the developer 123K for black are arranged as the developer part 123 in this order along the photosensitive member 121, according to this embodiment. The developers 123Y, 123C, 123M and 123K are each capable of freely abutting to and departing from the photosensitive member 121. In response to an instruction from the control unit 6, one of the four developers 123Y, 123C, 123M and 123K selectively contacts the photosensitive member 121, supplies toner of a selected color to a surface of the photosensitive member 121 by means of an applied high voltage, and visualizes the electrostatic latent image on the photosensitive member 121.

The toner image developed by the developer part 123 is primarily transferred, in a primary transfer area located between the black developer 123K and the cleaner blade 124 for the photosensitive member 121, onto an intermediate transfer belt 141 (image carrier) of a transfer unit 104. Further, as the cleaner blade 124 for the photosensitive member is disposed at a position ahead of the primary transfer area in a circumferential direction (which is the direction indicated at the arrow in FIG. 3), the toner still sticking to the outer circumferential surface of the photosensitive member 121 is scraped off.

The transfer unit 104 comprises seven rollers 142 to 148, and the endless intermediate transfer belt 141 is spun across the six rollers 142 to 147 except for the secondary transfer roller 148. For transfer of a color image onto a sheet S, toner images of the respective colors formed on the photosensitive member 121 are laid one atop the other on the intermediate transfer belt 141 thereby forming a color image, during which the sheet S unloaded from a cassette or a hand-feed tray travels to a secondary transfer area moving passed between an upper guide member 105U and a lower guide member 105D, whereby the color image is secondarily transferred onto the sheet S and the color image is obtained (color printing process). Meanwhile, for transfer of a monochrome image onto a sheet S, only a black toner image on the photosensitive member 121 is formed on the intermediate transfer belt 141 and thereafter transferred onto a sheet S conveyed to the secondary transfer area in a manner similar to that for a color image, whereby the monochrome image is obtained (monochrome printing process).

A belt cleaner 149 is disposed facing the roller 146, and after the secondary transfer, the belt cleaner 149 removes and cleans residual toner off the intermediate transfer belt 141. Further, there is a sensor 140 below the roller 143 for detection of a reference position of the intermediate transfer belt 141. This sensor serves as a vertical synchronization reader sensor for obtaining a synchronizing signal in a sub scanning direction which is approximately perpendicular to a main scanning direction, i.e., a vertical synchronizing signal.

A main part 2 of a toner quantity measuring apparatus which measures the quantity of toner adhering on the intermediate transfer belt 141 is disposed facing the roller 143 across the intermediate transfer belt 141. Based on the quantity of toner adhering to the surface of the intermediate transfer belt 141 measured by this toner quantity measuring apparatus, a control unit 6 adjusts process conditions such as an electrifying bias and a developing bias and controls an image density.

Figure 4:
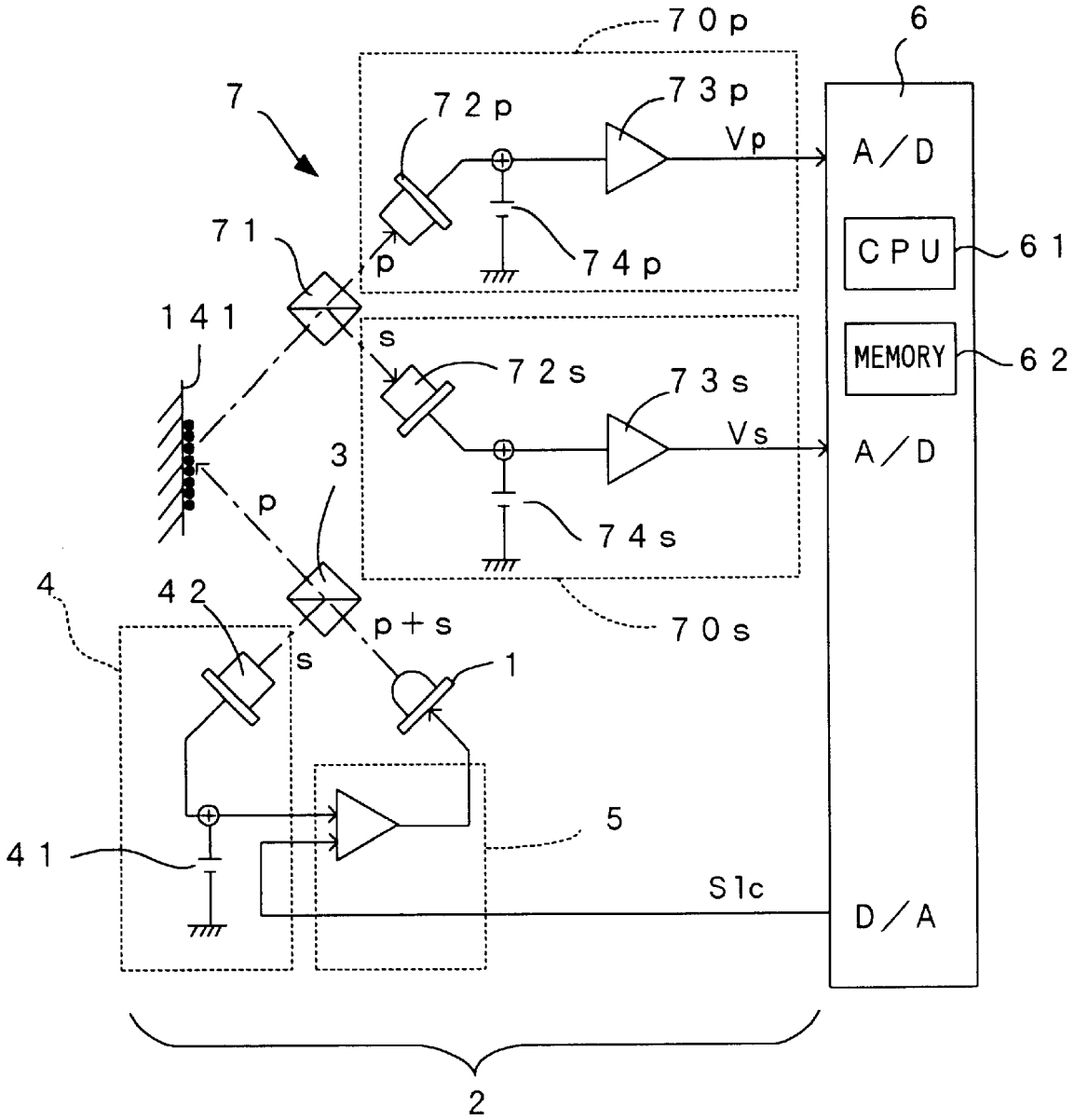
FIG. 4 is a drawing of a toner quantity measuring apparatus which is incorporated within the image forming apparatus shown in FIG. 3.

FIG. 4 is a drawing showing a first preferred embodiment of the toner quantity measuring apparatus which is incorporated within the image forming apparatus shown in FIG. 3. This toner quantity measuring apparatus comprises a light emitting element 1 such as an LED which irradiates light toward the intermediate transfer belt 141. Further, according to this embodiment, for the purpose of adjusting the quantity of the irradiation, there are a polarizing beam splitter 3, an irradiation quantity monitoring light receiving unit 4 and an irradiation quantity adjusting unit 5.

The polarizing beam splitter 3 is located between the light emitting element 1 and the intermediate transfer belt 141 as shown in FIG. 4, and splits into p-polarized light whose polarization direction is parallel to a surface of incidence of the irradiated light on the intermediate transfer belt 141 and s-polarized light whose polarization direction is perpendicular to the surface of incidence. While the p-polarized light as it is impinges upon the intermediate transfer belt 141, the s-polarized light enters the irradiation quantity monitoring light receiving unit 4 after leaving the polarizing beam splitter 3 so that a signal which is in proportion to the quantity of the irradiated light from the light receiving unit 4 is outputted to the irradiation quantity adjusting unit 5. Receiving this signal, the irradiation quantity adjusting unit 5 feedback-controls the light emitting element 1 based on a light quantity control signal Slc provided from the control unit 6 which comprises a CPU 61 and a memory 62 and controls the apparatus as a whole, whereby the quantity of the irradiated light from the light emitting element 1 illuminating the intermediate transfer belt 141 is adjusted to a value which corresponds to the light quantity control signal Slc. In this manner, this embodiment permits to change and adjust the quantity of irradiation in a wide range.

Figure 1:
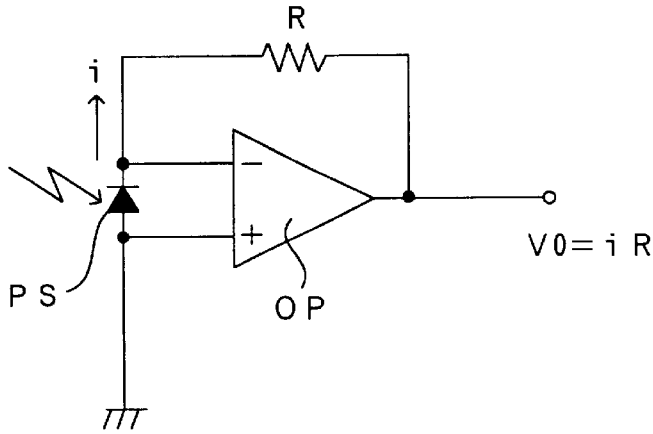
FIG. 1 (PRIOR ART)
FIG. 1 is a drawing of an electric structure of a conventional light receiving unit.
Figure 5:
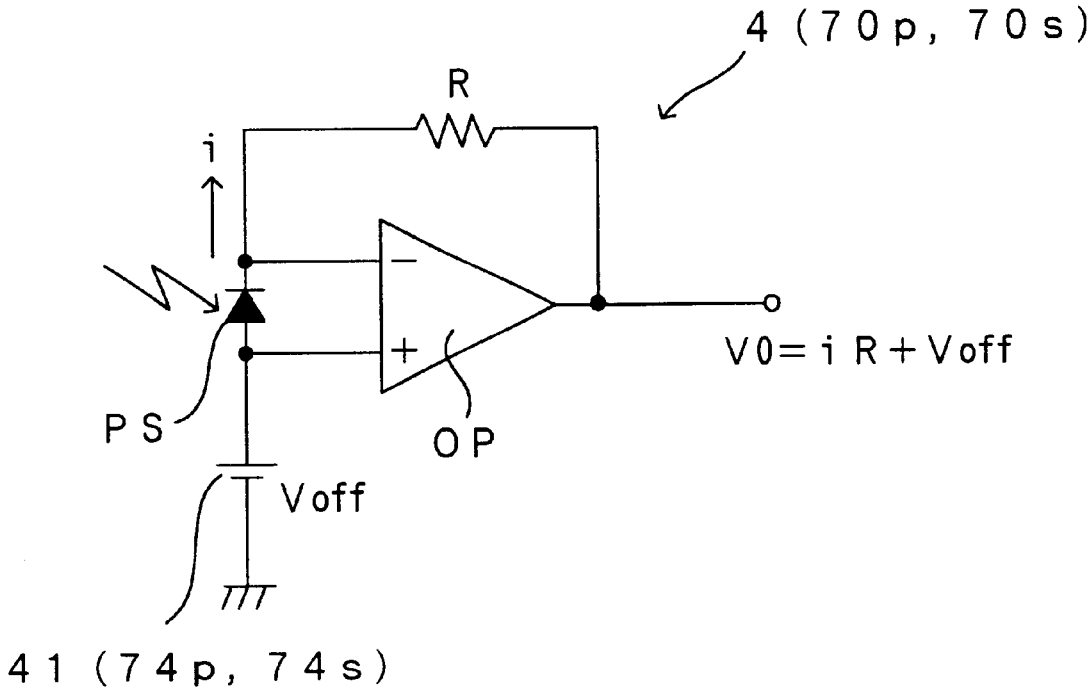
FIG. 5 is a drawing of an electric structure of a light receiving unit which is used in the toner quantity measuring apparatus shown in FIG. 4.

Further, according to this embodiment, an input offset voltage 41 is applied to the output side of a light receiving element 42 which is disposed to the irradiation quantity monitoring light receiving unit 4, and therefore, the light emitting element 1 is maintained turned off unless the light quantity control signal Slc exceeds a certain signal level. A specific electric structure of this is as shown in FIG. 5, which is different from the conventional light receiving unit (FIG. 1) with respect to the following point. That is, while the anode terminal of the light receiving element PS and the non-inversion input terminal of the operational amplifier OP are both directly coupled to the ground potential in the conventional light receiving unit which is shown in FIG. 1, the offset voltage 41 is interposed in this embodiment. Because of this, an output voltage V0 from the light receiving unit 4 is:

$V0=i\cdot R+V\text{off}$ (where Voff denotes an offset voltage value)

The reason of this structure is as follows.

Figure 6:
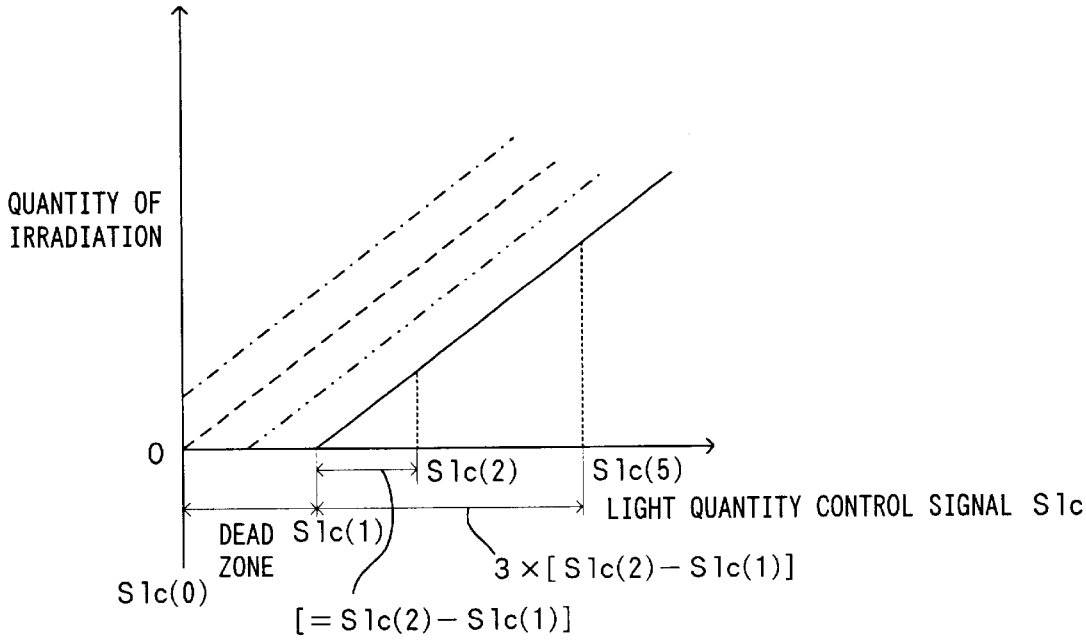
FIG. 6 is a drawing showing a light quantity control characteristic of the toner quantity measuring apparatus shown in FIG. 4.

Without application of the input offset voltage 41, a light quantity characteristic is as indicated at the dotted line in FIG. 6. That is, as the light quantity control signal Slc(0) is supplied to the irradiation quantity adjusting unit 5 from the control unit 6, the light emitting element 1 turns off. The light emitting element 1 turns on when the signal level of the light quantity control signal Slc increases, and the quantity of the irradiated light upon the intermediate transfer belt 141 as well increases in approximate proportion to the signal level. However, the light quantity characteristic sometimes shifts parallel as indicated at the dotted-and-dashed line or the double-dotted-and-dotted-and-dashed line in FIG. 6 due to an influence of an ambient temperature, the structure of the irradiation quantity adjusting unit 5, etc., and once a shift as that denoted at the dotted-and-dashed line in FIG. 6 occurs, for example, the light emitting element 1 may stay turned on despite a turn-off instruction, namely, the light quantity control signal Slc(0) from the control unit 6. In contrast, where a shift toward the right-hand side in FIG. 6 (which is denoted at the solid line in FIG. 6) is provided in advance by means of application of the input offset voltage 41 and a dead zone (signal levels Slc(0) to Slc(1)) is consequently created as in this embodiment, with the turn-off instruction, namely, the light quantity control signal Slc(0) from the control unit 6, it is possible to turn off the light emitting element 1 without fail, and hence, prevent malfunction of the apparatus.

On the other hand, when the light quantity control signal Slc exceeding the signal level Slc(1) is supplied to the irradiation quantity adjusting unit 5 from the control unit 6, the light emitting element 1 turns on and p-polarized light is irradiated as irradiation toward the intermediate transfer belt 141. The intermediate transfer belt 141 reflects the p-polarized light, a reflection quantity detecting unit 7 detects the quantities of the p-polarized light and the s-polarized light among light components of the reflected light, and signals corresponding to the respective light quantities are outputted to the control unit 6.

The reflection quantity detecting unit 7 comprises a polarized beam splitter 71 which is disposed on an optical path of the reflected light, a light receiving unit 70*p* which receives the p-polarized light which travels through the polarized beam splitter 71 and outputs a signal corresponding to the quantity of the p-polarized light, and a light receiving unit 70*s* which receives the s-polarized light split by the polarized beam splitter 71 and outputs a signal corresponding to the quantity of the s-polarized light. In the light receiving unit 70*p*, a light receiving element 72*p* receives the p-polarized light from the polarized beam splitter 71, and after the output from the light receiving element 72*p* is amplified by an amplifier circuit 73*p*, the light receiving unit 70*p* outputs the amplified signal as a signal which corresponds to the quantity of the p-polarized light. Further, like the light receiving unit 70*p*, the light receiving unit 70*s* comprises a light receiving element 72*s* and an amplifier circuit 73*s*. Hence, it is possible to independently derive the light quantities of two component light (i.e., the p-polarized light and the s-polarized light) which are different from each other among light components of the reflected light.

Figure 2:
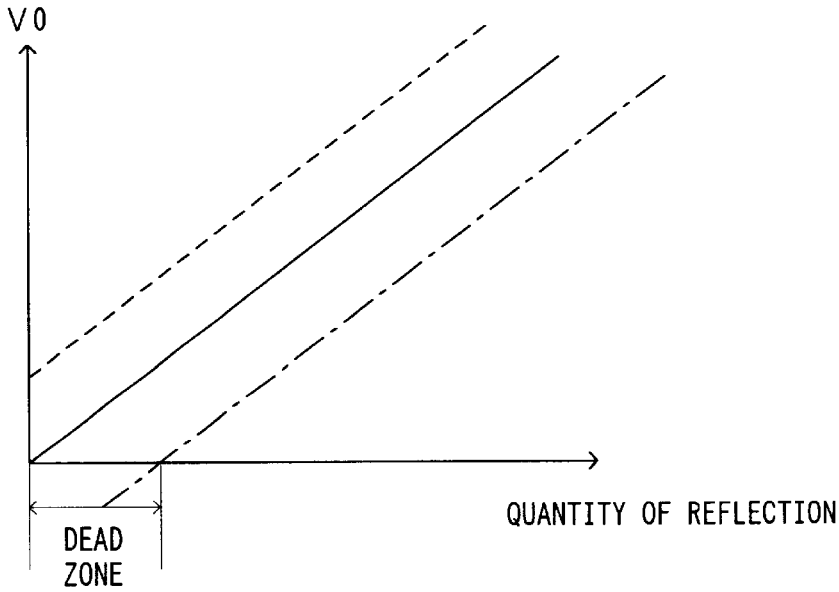
FIG. 2 (PRIOR ART)
FIG. 2 is a graph showing a change in output voltage with respect to the quantity of reflected light where an output offset voltage is not applied.
Figure 7:
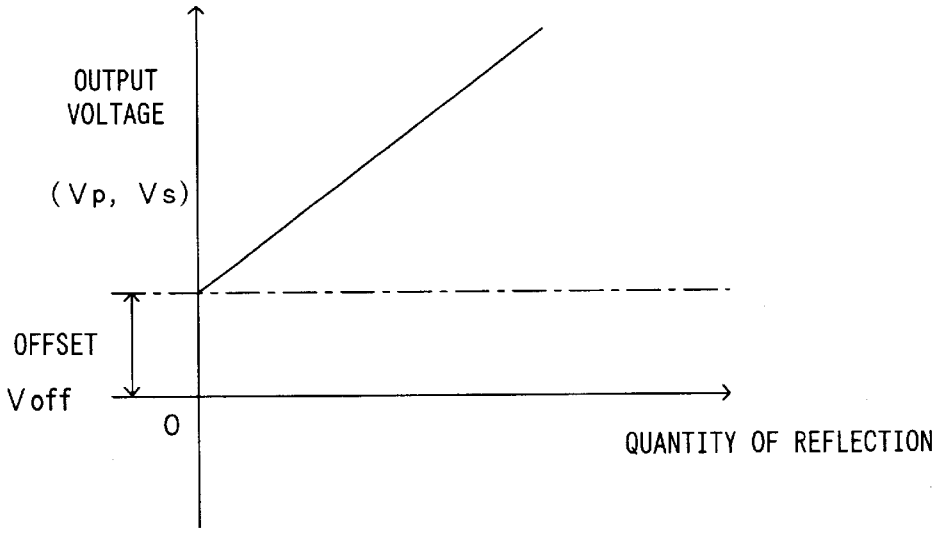
FIG. 7 is a graph showing a change in output voltage with respect to the quantity of reflected light in the toner quantity measuring apparatus shown in FIG. 4.

Further, in this embodiment, output offset voltages 74*p*, 74*s* are applied respectively to the output side of the light receiving elements 72*p*, 72*s*, and output voltages Vp, Vs of signals supplied to the control unit 6 from the amplifier circuits 73*p*, 73*s* are offset to the positive side as shown in FIG. 7. Specific electric structures of the respective light receiving units 70*p*, 70*s* are the same as that of the light receiving unit 4, and therefore, will not be shown in drawings. In the light receiving units 70*p*, 70*s* having such structures as well, the output voltages Vp, Vs each have a value which is equal to or larger than zero even when the quantity of the reflected light is zero, and moreover, the output voltages Vp, Vs increase proportionally as the quantity of the reflected light increases, which is similar as in the light receiving unit 4. In this manner, with application of the output offset voltages 74*p*, 74*s*, it is possible to eliminate an influence of the dead zone which is shown in FIG. 2 without fail and output an output voltage which corresponds to the quantity of the reflected light.

The signals having the output voltages Vp, Vs are supplied to the control unit 6 and A/D-converted, after which the control unit 6 which has a function as toner quantity calculating means calculates the quantity of toner adhering on the intermediate transfer belt 141 in accordance with an operation flow below. In the following, a method of measuring a toner quantity will be described in detail with reference to FIGS. 8 and 9.

Figure 8:
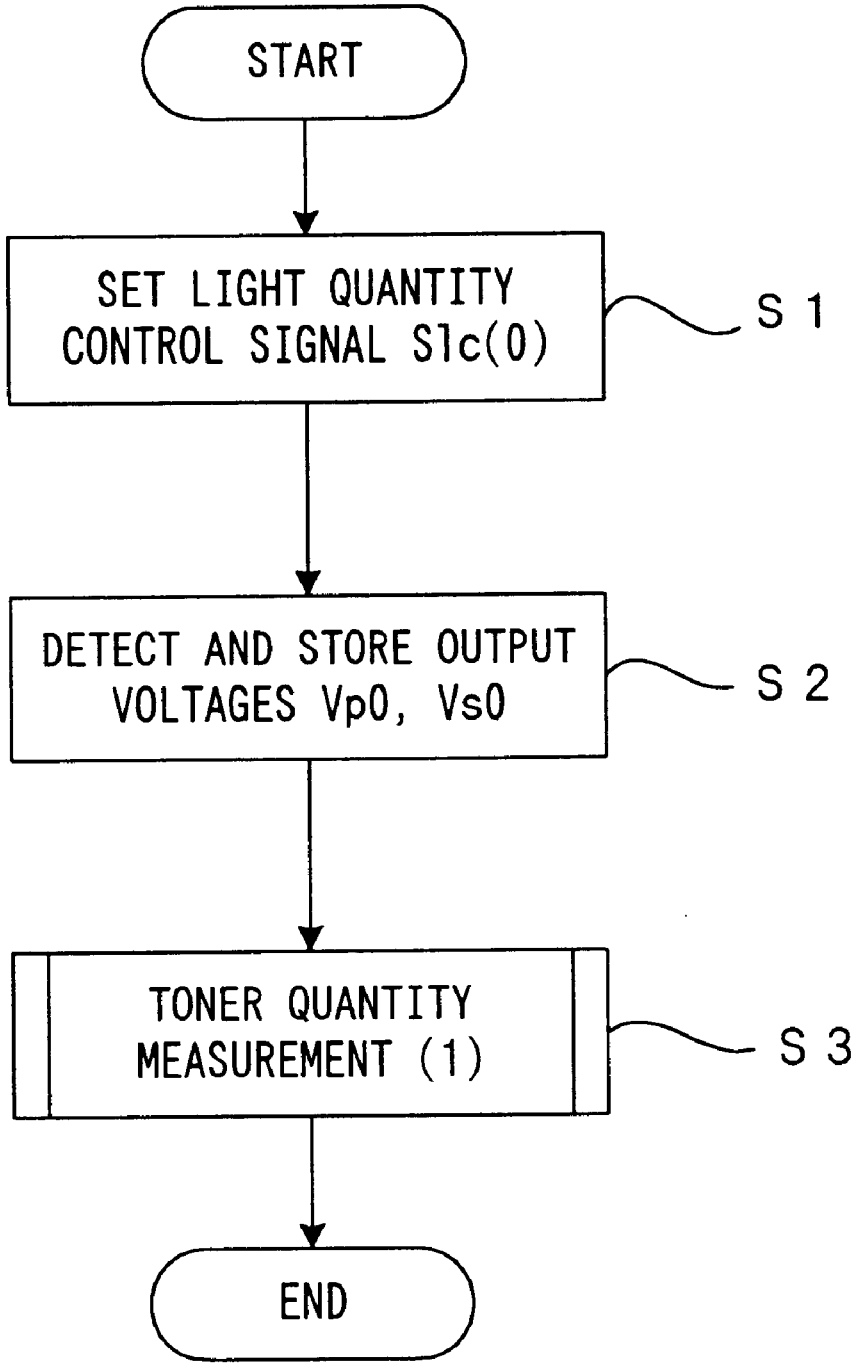
FIG. 8 is a flow chart showing operations of the toner quantity measuring apparatus shown in FIG. 4.

FIG. 8 is a flow chart showing operations of the toner quantity measuring apparatus which is shown in FIG. 4. In this apparatus, the control unit 6 outputs the light quantity control signal Slc(0) which corresponds to the turn-off instruction to the irradiation quantity adjusting unit 5 and accordingly turns off the light emitting element 1 (Step S1). According to this embodiment, in particular, as described above, the dead zone (signal level Slc(0) to Slc(1)) is set up by means of application of the input offset voltage 41, and therefore, the light emitting element 1 is turned off without fail upon application of the light quantity control signal Slc(0).

An output voltage Vp0 which is indicative of the quantity of the p-polarized light and an output voltage Vs0 which is indicative of the quantity of the s-polarized light in this OFF-state are detected and stored in the memory 62 of the control unit 6 (Step S2). In short, a sensor output in the OFF-state, namely, dark output information is detected and stored.

Figure 9:
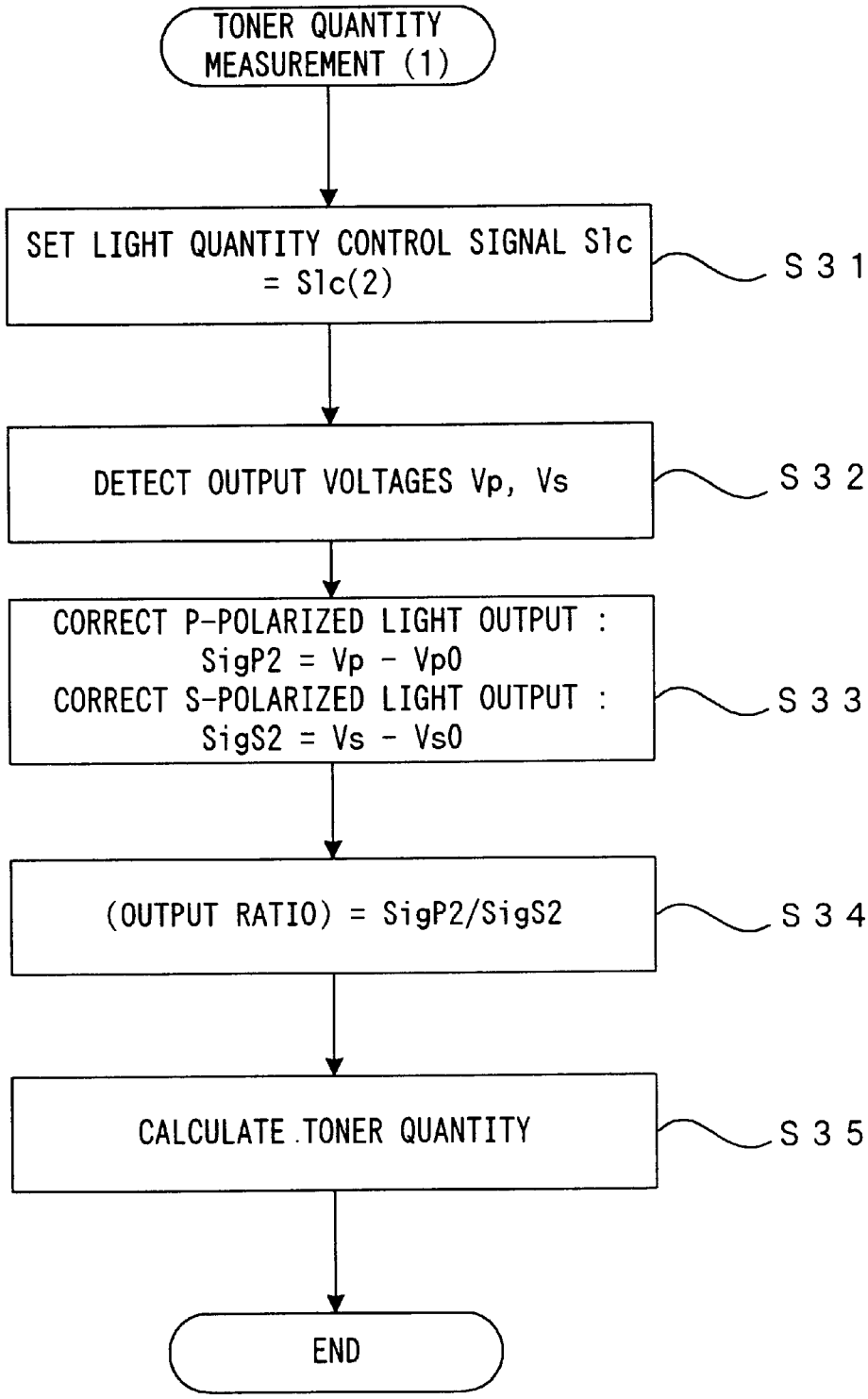
FIG. 9 is a flow chart showing operations of a toner quantity measurement process (1)

Step S3 is thereafter executed to derive the quantity of toner adhering on the intermediate transfer belt 141. FIG. 9 is a flow chart showing operations of a toner quantity measurement process (1). In the toner quantity measurement process (1), a signal Slc(2) at a signal level beyond the dead zone is set as the light quantity control signal Slc , and the light quantity control signal Slc(2) is supplied to the irradiation quantity adjusting unit 5 to thereby turn on the light element 1 (Step S31). This causes light from the light emitting element 1 to irradiate upon the intermediate transfer belt 141, the reflection quantity detecting unit 7 to detect the quantities of the p-polarized light and the s-polarized light which are reflected by the intermediate transfer belt 141, and the control unit 6 to receive the output voltages Vp, Vs which correspond to the respective light quantities (Step S32).

The control unit 6 subtracts the dark output voltage Vp0 from the output voltage Vp with respect to the p-polarized light, thereby calculating a light quantity signal SigP2 which represents the quantity of the p-polarized light which corresponds to the toner quantity (Step S33). With respect to the s-polarized light as well, similarly to the p-polarized light, the control unit 6 subtracts the dark output voltage Vs0 from the output voltage Vs to derive a light quantity signal SigS2 which represents the quantity of the s-polarized light which corresponds to the toner quantity (Step S33). Since the dark output voltages Vp0, Vs0 are removed from the measured output voltages Vp, Vs according to this embodiment, it is possible to accurately calculate the light quantities which correspond to the toner quantity. Therefore, even when there is a change in the dark outputs due to an environmental condition, such as an ambient temperature around the apparatus, or a change with time of the components which form the apparatus, it is possible to obtain the outputs which correspond to the toner quantity without an influence of this.

Figure 10:
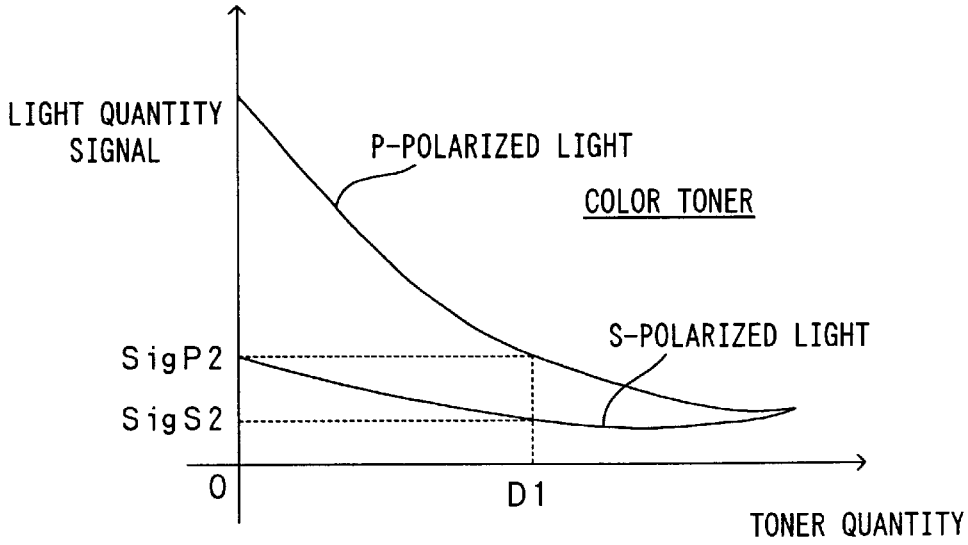
FIG. 10 is a graph showing a change in output voltage with respect to a color toner quantity.
Figure 11:
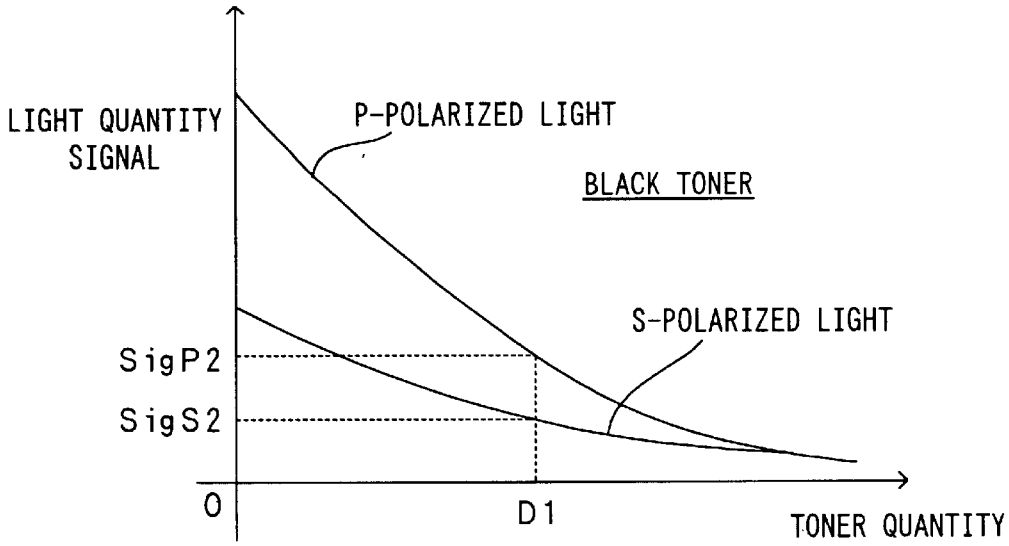
FIG. 11 is a graph showing a change in output voltage with respect to a black toner quantity.

If gains of the respective amplifier circuits 73*p*, 73*s* set such that the light quantity signals SigP2, SigS2 as they are when a toner quantity is set to maximum have the same value (SigP2=SigS2), changes in the light quantity signals SigP2, SigS2 in response to the quantity of color toner show as in FIG. 10 and changes in the light quantity signals SigP2, SigS2 in response to the quantity of black toner show as in FIG. 11. As these graphs clearly show, the light quantity signals SigP2, SigS2 as well change largely when the toner quantity changes, and an output ratio (=SigP2/SigS2) in the case of color toner, in particular, decreases in accordance with an increase in toner quantity (not shown) and becomes "1" when the toner quantity is maximum (SigP2=SigS2).

At Step S34, a ratio between the light quantity signals SigP2, SigS2 corrected in the manner above is then calculated, and a toner quantity D1 (See FIGS. 10 and 11) is calculated based on the calculated output ratio (=SigP2/SigS2) (Step S35).

In the first preferred embodiment, as described above, the quantity of the p-polarized light as a first light component (light quantity signal SigP2) and the quantity of the s-polarized light as a second light component (light quantity signal SigS2), out of the light components of the reflected light from the intermediate transfer belt 141, are found independently of each other, and the quantity of toner adhering on the intermediate transfer belt 141 is measured based on an output ratio between these two (=SigP2/SigS2), and therefore, highly accurate measurement of the toner quantity is possible with less susceptibility to an influence of a noise or a change in quantity of light irradiated upon the intermediate transfer belt 141.

In addition, according to the first preferred embodiment, since the dark output voltages Vp0, Vs0 are obtained in advance as dark output information and subtracted, for the purpose of correction, from the output voltages (received light quantity information) Vp, Vs which are detected during measurement of an actual quantity of toner, it is possible to further improve the accuracy of measuring the toner quantity by means of the elimination of an influence of the dark output voltages Vp0, Vs0.

Further, while it is necessary to turn off the light emitting element 1 without fail to calculate the dark outputs, according to the first preferred embodiment, it is possible to turn off the light emitting element 1 without fail by means of application of the input offset voltage 41 as described earlier.

Of course, although the preferred embodiment above requires to obtain the quantity of toner based on the output ratio (=SigP2/SigS2), the quantity of the toner may be obtained based on an output ratio (=Vs2/Vp2) or a correlation between the quantity of the p-polarized light and the quantity of the s-polarized light. When the quantity of the toner is to be obtained based on the output ratio, the correlation or the like in this manner, output ratios or correlations at different toner quantities are identified in advance on a standard sample whose toner quantity is known and stored in the memory 62. Such modifications are commonly applied to preferred embodiments as well which will be described later.

The control unit 6 not only serves as toner quantity calculating means of the toner quantity measuring apparatus as described above, but adjusts process conditions such as an electrifying bias and a developing bias based on the measurement result (the quantity of adhering toner) if necessary and accordingly controls an image density. This allows to create an image with a stable density.

By the way, although the toner quantity measuring apparatus according to the first preferred embodiment is incorporated in the image forming apparatus described above, a toner quantity measuring apparatus described below as following preferred embodiments may be incorporated instead.

While the toner quantity measurement process (1) is carried out to measure the quantity of toner which adheres to the intermediate transfer belt 141 regardless of a toner color of the toner in the toner quantity measuring apparatus according to the first preferred embodiment above, as FIGS. 10 and 11 show, the output voltages change differently with respect to a toner quantity between color toner (FIG. 10) and black toner (FIG. 11). Noting this, in a toner quantity measuring apparatus according to a second preferred embodiment, two types of toner quantity measurement processes (1), (2) are prepared in advance and selectively executed in accordance with a toner color of toner adhering on the intermediate transfer belt 141. In the following, the second preferred embodiment will be described in detail with reference to FIGS. 12 and 13. Electric and optical structures of toner quantity measuring apparatuses according to the second preferred embodiment, a third and a fourth preferred embodiments which will be described later are exactly the same as those according to the first preferred embodiment, and therefore, will not be described. Instead, a specific toner quantity measurement flow will be mainly described.

Figure 12:
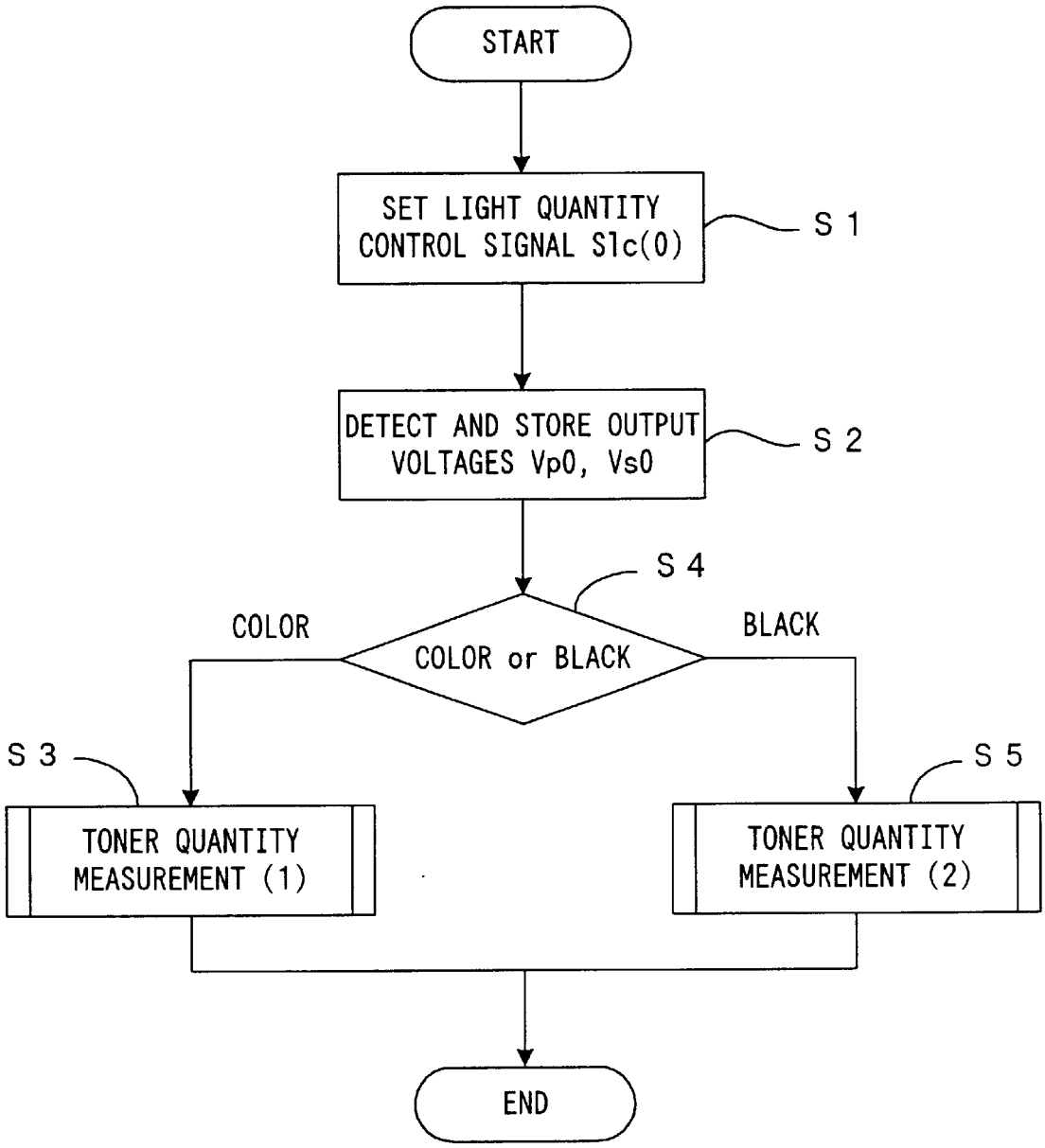
FIG. 12 is a flow chart showing operations of the toner quantity measuring apparatus according to the present invention in another preferred embodiment.

FIG. 12 is a flow chart showing operations in the second preferred embodiment of the toner quantity measuring apparatus according to the present invention. In the second preferred embodiment, as in the first preferred embodiment, Steps S1, S2 are executed and a sensor output in the OFF-state, namely, the dark output voltages Vp0, Vs0 are detected and stored. Following this, at Step S4, whether toner adhering to the intermediate transfer belt 141 is color toner or black toner is determined. The control unit 6 of an image forming apparatus of this type holds sequence control information which contains an order of forming toner images on the intermediate transfer belt 141 and the sequence control information also contains information regarding a toner color in which an image is being created and information regarding a toner color of a toner image which is positioned in front of the sensor. Hence, the control unit 6 may execute Step S4 for judgment based on this toner color information.

When it is determined at Step S4 that the toner adhering to the intermediate transfer belt 141 is color toner, the sequence proceeds to Step S3 to carry out the toner quantity measurement process (1). Operations of toner quantity measurement at this stage are exactly the same as those according to the first preferred embodiment, and therefore, will not be described. On the other hand, when it is determined at Step S4 that the toner adhering to the intermediate transfer belt 141 is black toner, the sequence proceeds to Step S5 to carry out the toner quantity measurement process (2).

Figure 13:
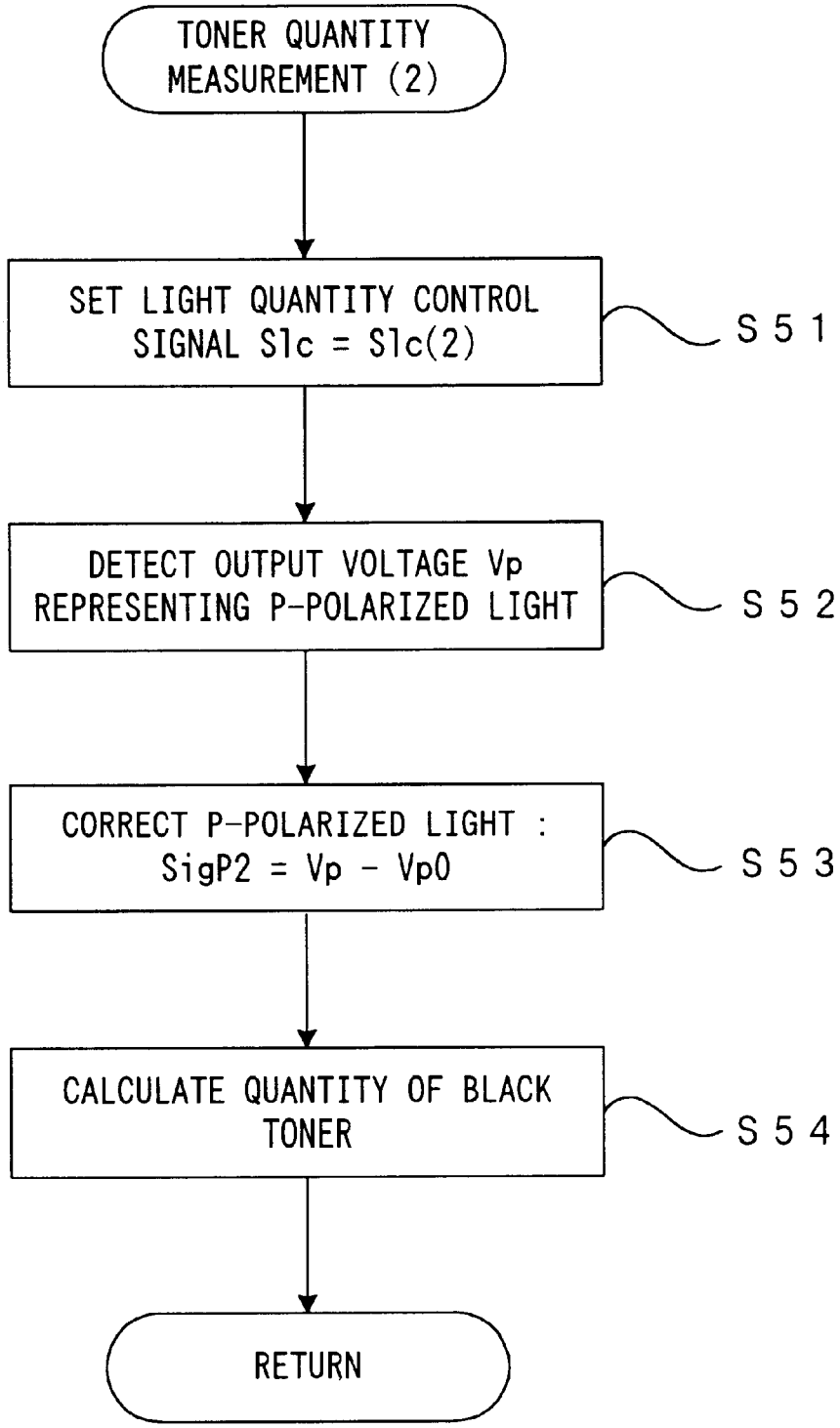
FIG. 13 is a flow chart showing operations of a toner quantity measurement process (2) shown in FIG. 12.

FIG. 13 is a flow chart showing operations during the toner quantity measurement process (2) shown in FIG. 12. In the toner quantity measurement process (2), the signal Slc(2) which is at a signal level beyond the dead zone is set as the light quantity control signal Slc, and the light quantity control signal Slc(2) is supplied to the irradiation quantity adjusting unit 5 to thereby turn on the light element 1 (Step S51). This causes light from the light emitting element 1 to irradiate upon the intermediate transfer belt 141, the reflection quantity detecting unit 7 to detect the quantities of the p-polarized light and the s-polarized light of the light which is reflected by the intermediate transfer belt 141, and the control unit 6 to receive the output voltages Vp, Vs which correspond to the respective light quantities. In the toner quantity measurement process (2), however, only the output voltage Vp regarding the p-polarized light is detected (Step S52).

At Step S53, the dark output voltage Vp0 is subtracted from the output voltage Vp regarding the p-polarized light and the light quantity signal SigP2 which is indicative of the quantity of the p-polarized light which corresponds to the quantity of black toner is accordingly found (Step S53). In this manner, according to the second preferred embodiment as well, as in the first preferred embodiment, the dark output voltage Vp0 is removed from the measured output voltage Vp, and hence, it is possible to accurately calculate a light quantity which corresponds to the quantity of the black toner. Even when there is a change in the dark output due to an environmental condition, such as an ambient temperature around the apparatus, or a change with time of the components which form the apparatus, it is therefore possible to obtain an output which reflects the quantity of the black toner without an influence of this.

At Step S54 subsequently, the toner quantity D1 is detected based on the light quantity signal SigP2 which is corrected in the manner above. This is because when black toner adheres to the intermediate transfer belt 141, the output voltages representing the p-polarized light and the s-polarized light monotonously decrease in accordance with an increase in black toner quantity as shown in FIG. 11. Further, since a dynamic range of the p-polarized light is larger than that of the s-polarized light as comparison of the output voltages representing the p-polarized light and the s-polarized light indicates, when measured based on the output voltage representing the p-polarized light whose dynamic range is wider, a toner quantity is more accurately measured.

In the second preferred embodiment, although the dynamic range of the p-polarized light is larger than that of the s-polarized light because of a characteristic of the beam splitter, when a beam splitter having a different characteristic is used, the dynamic range of the s-polarized light can be larger than that of the p-polarized light, in which case it is possible to measure a toner quantity based on an output voltage representing the s-polarized light.

As described above, the second preferred embodiment realizes the following effect in addition to an effect which is similar to that according to the first preferred embodiment. That is, since the two toner quantity measurement processes (1), (2) which are different from each other are prepared in advance and selectively carried out in accordance with a toner color of toner adhering to the intermediate transfer belt 141 according to the second preferred embodiment, it is possible to measure a toner quantity in an optimal measurement flow for each toner color, and therefore, more accurately measure a toner quantity.

Figure 14:
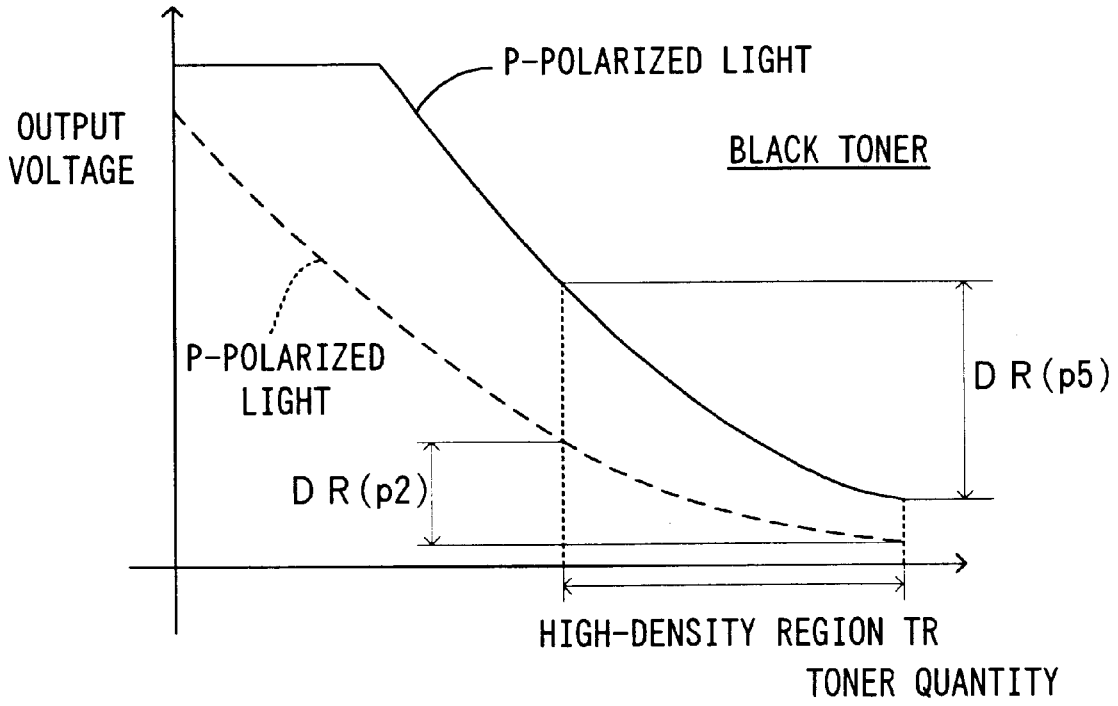
FIG. 14 is a graph showing a change in output voltage with respect to a black toner quantity as the quantity of reflected light increases.

By the way, a reduction rate of an output voltage with respect to a toner quantity is smaller in a high-density region than in a mid- and a low-density regions as indicated at the dotted line in FIG. 14. For instance, when the light quantity control signal Slc(2) is supplied to the irradiation quantity adjusting unit 5 and the light element 1 is consequently turned on as in the second preferred embodiment, a width of change in output for the high-density region TR is DR(p2). As a result, the accuracy of measuring a toner quantity in the high-density region becomes lower than in the mid-and the low-density regions. Noting this, according to the third preferred embodiment described below, for measurement of the quantity of high-density black toner, the quantity of irradiated light is increased and the output change width in the high-density region is widened to thereby improve a measurement accuracy in the high-density region TR.

Figure 15:
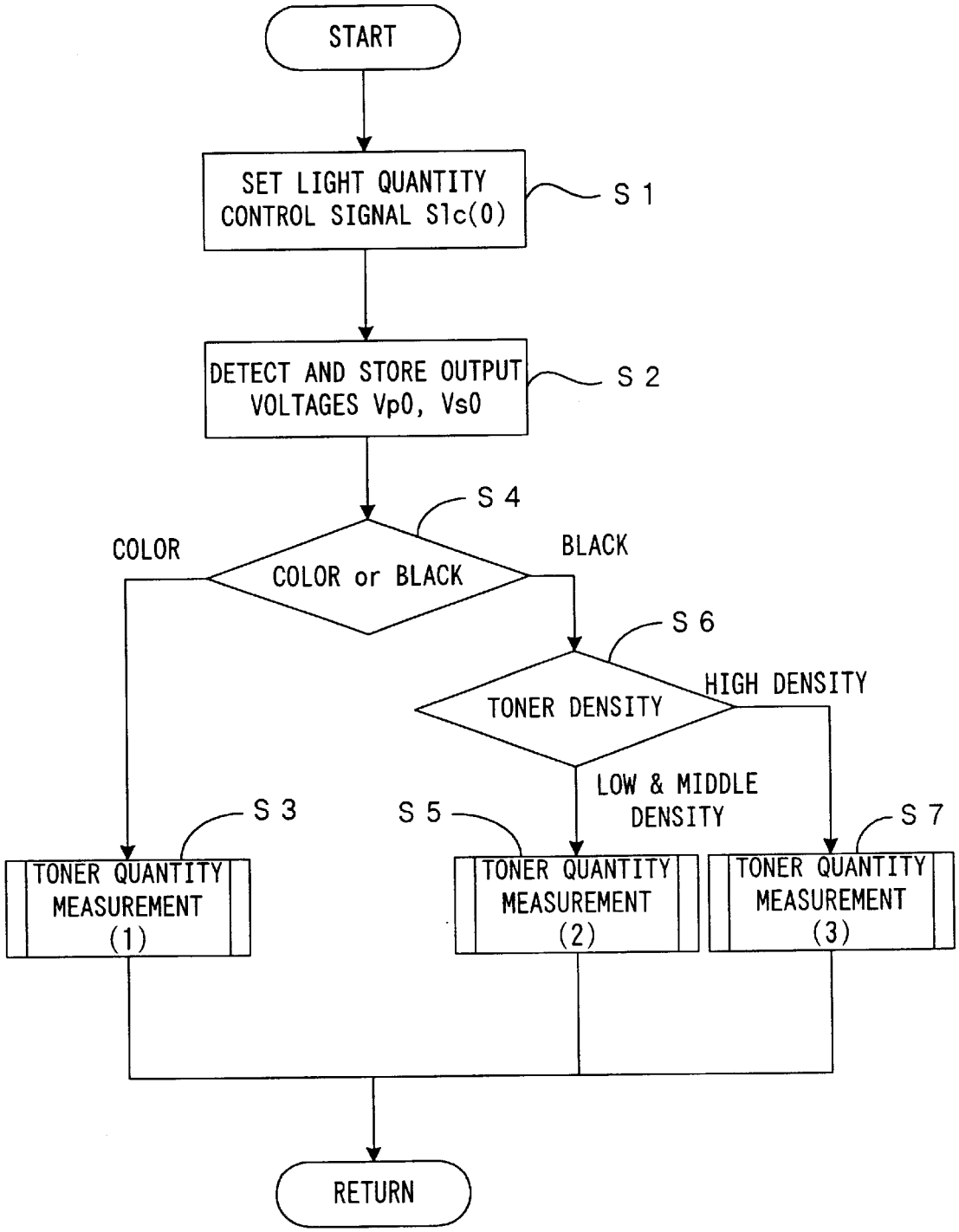
FIG. 15 is a flow chart showing operations of the toner quantity measuring apparatus according to the present invention in still other preferred embodiment.

FIG. 15 is a flow chart showing operations in the third preferred embodiment of the toner quantity measuring apparatus according to the present invention. The third preferred embodiment requires to execute Steps S1, S2 and detect and store a sensor output in the OFF-state, namely, the dark output voltages Vp0, Vs0. Following this, at Step S4, whether toner adhering to the intermediate transfer belt 141 is color toner or black toner is determined. When it is determined at Step S4 that the toner adhering to the intermediate transfer belt 141 is color toner, the sequence proceeds to Step S3 to carry out the toner quantity measurement process (1). Operations of toner quantity measurement at this stage are exactly the same as those according to the first preferred embodiment, and therefore, will not be described. On the other hand, when it is determined at Step S4 that the toner adhering to the intermediate transfer belt 141 is black toner, the sequence proceeds to Step S6.

At Step S6, whether the density of the toner adhering to the intermediate transfer belt 141 is high, middle or low is determined. This type of toner quantity measuring apparatus comprises means which holds image information regarding a toner image which is formed on the intermediate transfer belt 141. Since a general judgment can be made on a toner density of a toner image based on this information, the control unit 6 may make a judgment at Step S6 based on this image information.

When it is determined at Step S6 that the toner density is a middle or low density, the sequence proceeds to Step S5 to carry out the toner quantity measurement process (2). Operations of toner quantity measurement at this stage are exactly the same as those according to the second preferred embodiment, and therefore, will not be described. On the other hand, when it is determined at Step S6 that the toner density is a high density, the sequence proceeds to Step S7 to carry out a toner quantity measurement process (3).

Figure 16:
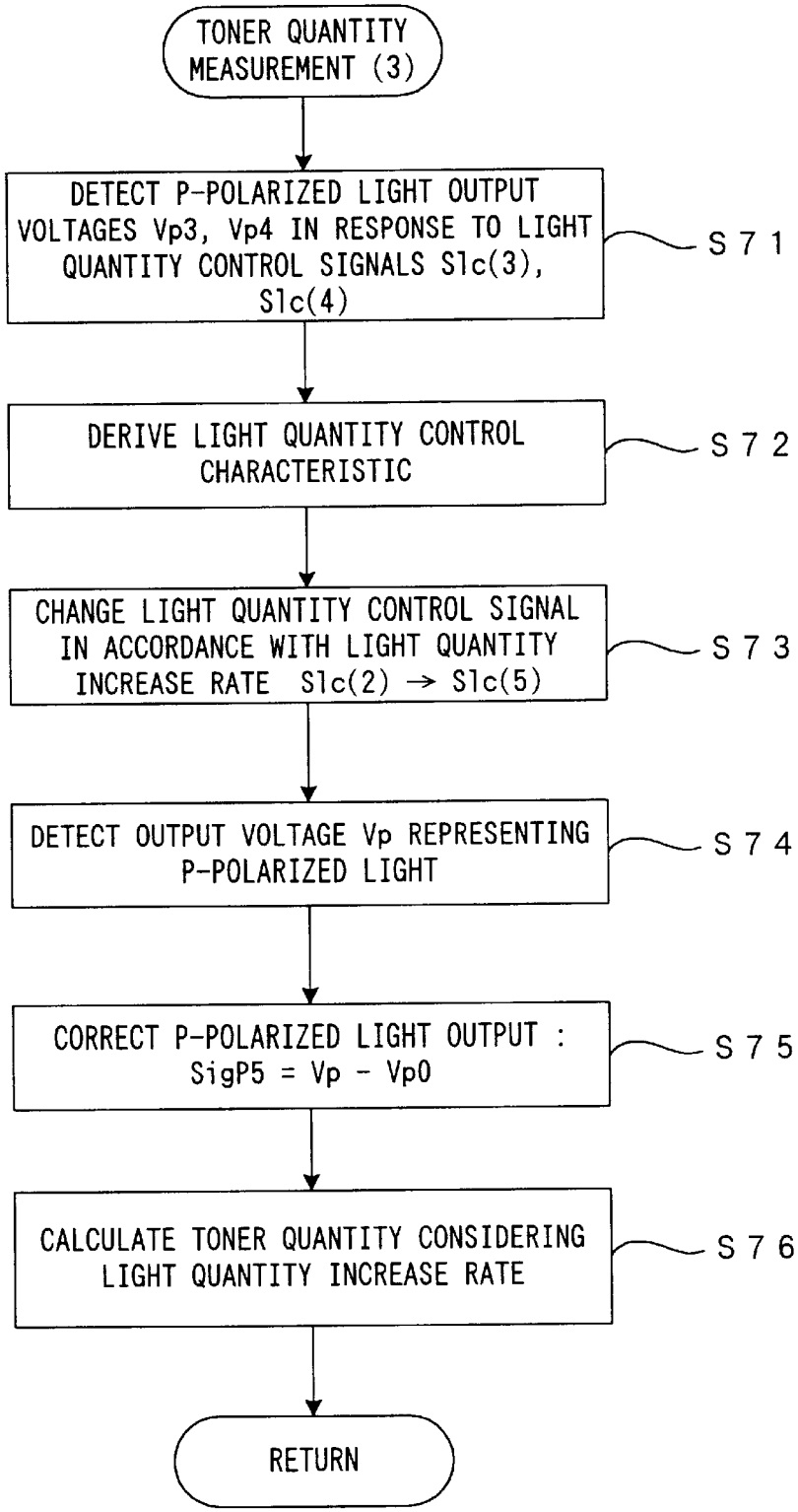
FIG. 16 is a flow chart showing operations of a toner quantity measurement process (3) shown in FIG. 15.

FIG. 16 is a flow chart of operations during the toner quantity measurement process (3) which is shown in FIG. 15. In the toner quantity measurement process (3), the following is done before a toner image is formed. First, a signal Slc(3) which is at a signal level beyond the dead zone is set as the light quantity control signal Slc, and the light quantity control signal Slc(3) is supplied to the irradiation quantity adjusting unit 5 to thereby turn on the light element 1, and an output voltage Vp3 for the p-polarized light is detected. Following this, a signal Slc(4) which is at a signal level beyond the light quantity control signal Slc(3) is set as the light quantity control signal Slc, and the light quantity control signal Slc(4) is supplied to the irradiation quantity adjusting unit 5 to thereby turn on the light element 1, and an output voltage Vp4 for the s-polarized light is detected (Step S71).

Figure 17:
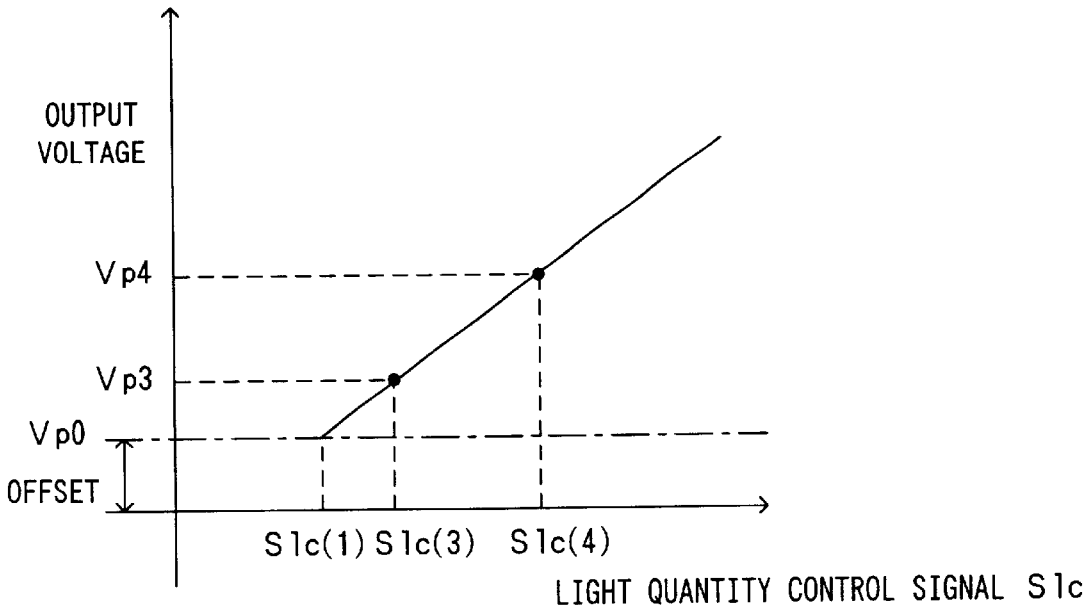
FIG. 17 is a graph showing a change in output voltage with respect to a light quantity control signal.

From these results of the detection, a light quantity control characteristic is derived (Step S72). More specifically, as shown in FIG. 17, the light quantity control characteristic is determined based on the output voltage Vp3 in response to the light quantity control signal Slc(3), the output voltage Vp4 in response to the light quantity control signal Slc(4) and the dark output Vp0, and the upper limit value Slc(1) of the dead zone is found. Following this, the signal level of the light quantity control signal is raised from the signal level Slc(2) which is used in the first and the second preferred embodiments to a signal level Slc(5), for the purpose of increasing the quantity of the irradiated light (Step S73). For example, where a light quantity increase rate is to be 3, as shown in FIG. 6, the light quantity control signal Slc(5) is set to a value which is calculated as:

$$Slc(5)=Slc(1)+3\times(Slc(2)-Slc(1))$$

Thus changed light quantity control signal Slc(5) is supplied to the irradiation quantity adjusting unit 5 and the light element 1 is consequently turned on. While this causes light from the light emitting element 1 to irradiate upon the intermediate transfer belt 141, the reflection quantity detecting unit 7 to detect the quantities of the p-polarized light and the s-polarized light of the light which is reflected by the intermediate transfer belt 141. The control unit 6 receives the output voltages Vp, Vs which correspond to the respective light quantities of the both polarized light. Since the irradiation upon the intermediate transfer belt 141 is greater due to the change made to the light quantity control signal, the output voltage representing the p-polarized light shifts toward the high-voltage side as indicated at the solid line in FIG. 14 and a width of change DR(p5) in output voltage for the high-density region TR widens. In addition, since the value to which the light quantity control signal is set is changed upon deriving of the light quantity control characteristic, it is possible to obtain an output voltage which highly accurately reflects the quantity of toner.

At Step S74 subsequently, after forming a toner image, the output voltage Vp representing the p-polarized light corresponding to the toner image is detected. Following this, the dark output voltage Vp0 is subtracted from the output voltage Vp, thereby calculating a light quantity signal SigP5 which represents the p-polarized light corresponding to the quantity of black toner in the high-density region (Step S75). In this manner, as in the first preferred embodiment, according to the third preferred embodiment as well, it is possible to accurately obtain a light quantity which corresponds to the quantity of the black toner since the dark output voltage Vp0 is subtracted from the measured output voltage Vp. Therefore, even when there is a change in the dark output due to an environmental condition, such as an ambient temperature around the apparatus, or a change with time of the components which form the apparatus, it is possible to obtain the output which reflects the quantity of the black toner without an influence of this.

The light quantity signal SigP5 is a value as it is when the irradiation has increased, and hence, at next Step S76, the toner quantity is calculated considering the light quantity increase rate.

As described above, the third preferred embodiment realizes the following effect in addition to an effect which is similar to those according to the first and the second preferred embodiments. That is, according to the third preferred embodiment, when high-density black toner remains adhering on the intermediate transfer belt 141, the quantity of irradiated light is increased and a toner quantity is measured with the width of change in output voltage of the p-polarized light in the high-density region TR widened from DR(p2) to DR(p5). Hence, it is possible to measure the toner quantity with a high accuracy even in the high-density region as well in addition to the mid- and the low-density regions. In other words, it is possible to measure the quantity of black toner with a high accuracy regardless of the density of the toner. Further, since the value to which the light quantity is set is changed for the purpose of increasing the quantity of the irradiation after deriving the light quantity control characteristic, it is possible to measure the toner quantity even more accurately.

Although the light quantity increase rate is 3 in the third preferred embodiment above, the light quantity increase rate is not limited to this. The quantity of light may be increased at a freely chosen rate.

In addition, although the third preferred embodiment above is directed to measurement of black toner on which the quantity of reflected light decreases rapidly, the width of change in output inevitably decreases in the high-density region also for measurement where color toner is used. Hence, even when the judgment at Step S4 is "COLOR" in FIG. 15, a process similar to that described in relation to "BLACK" may be of course applied to thereby measure the quantity of color toner with an even higher accuracy.

Figure 18:
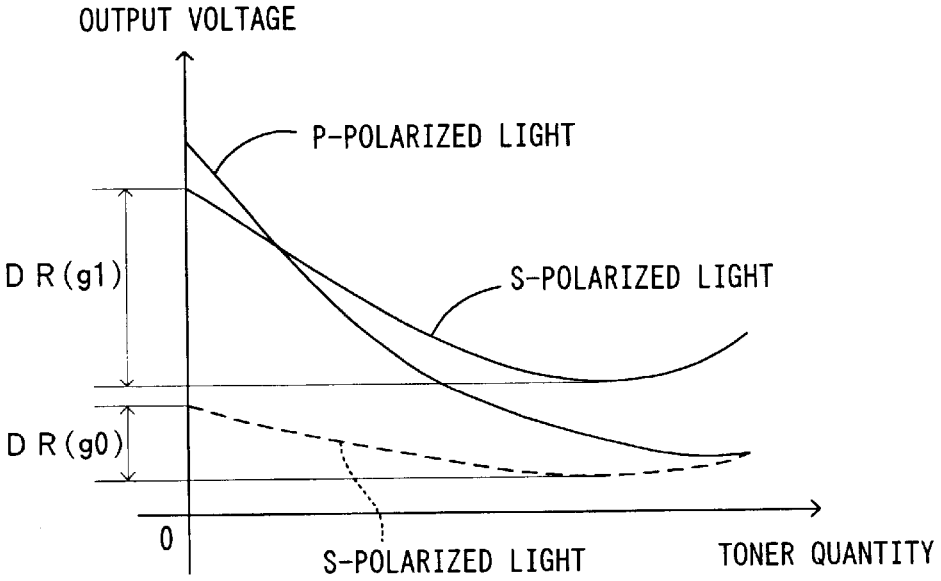
FIG. 18 is a graph showing a change in output voltage with respect to a toner quantity as a gain of an amplifier to s-polarized light increases.

By the way, according to the first to the third preferred embodiments described above, the gains of the respective amplifier circuits 73*p*, 73*s* are set such that the light quantity signals (Vp−Vp0, Vs−Vs0) as they are when a toner quantity is set to maximum have the same value with each other. With this setup, as denoted at the dotted line in FIG. 18, the dynamic range DR(g0) of the output voltage representing the p-polarized light is relatively narrow. However, when the gain of the amplifier circuit 73*s* is increased, as denoted at the solid line in FIG. 18, a dynamic range of an output voltage representing the s-polarized light expands into a dynamic range DR(g1), which makes it possible to measure a toner quantity even more accurately. In short, according to this embodiment aiming at improvement, a toner quantity measurement process (4) shown in FIG. 19 is executed instead of the toner quantity measurement process (1).

Figure 19:
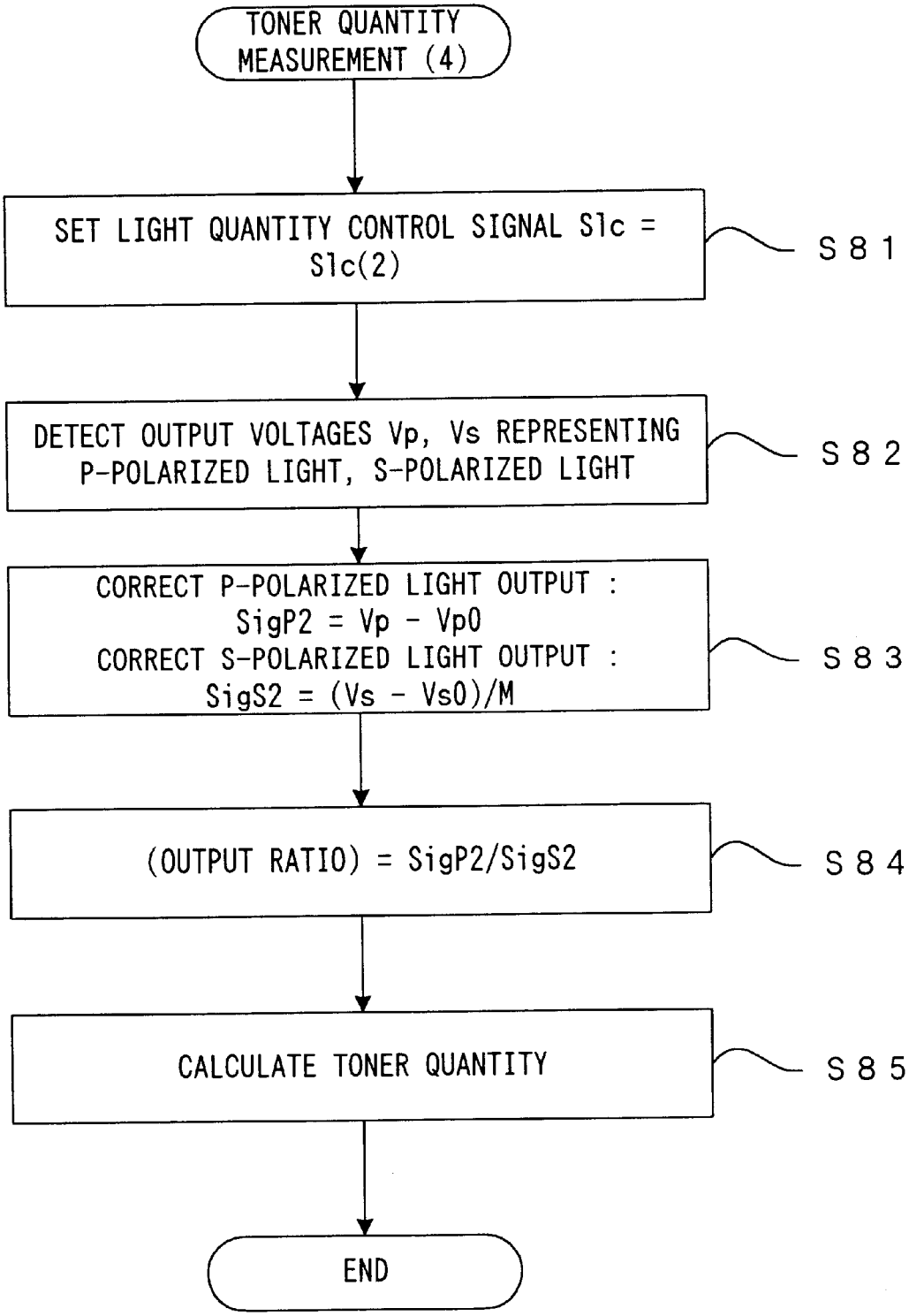
FIG. 19 is a flow chart showing operations of a toner quantity measurement process (4)

FIG. 19 is a flow chart showing operations during the toner quantity measurement process (4). In the toner quantity measurement process (4), the signal Slc(2) at a signal level beyond the dead zone is set as the light quantity control signal Slc, and the light quantity control signal Slc(2) is supplied to the irradiation quantity adjusting unit 5 to thereby turn on the light element 1 (Step S81). This causes light from the light emitting element 1 to irradiate upon the intermediate transfer belt 141, the reflection quantity detecting unit 7 to detect the quantities of the p-polarized light and the s-polarized light of the light which is reflected by the intermediate transfer belt 141, and the control unit 6 to receive the output voltages Vp, Vs which correspond to the respective light quantities (Step S82). According to this embodiment aiming at improvement, since the gain of the amplifier circuit 73*s* is set in advance M-times (M>1) as large as that in the first preferred embodiment, the dynamic range of the output voltage representing the s-polarized light is enhanced to the dynamic range DR(g1) from the dynamic range DR(g0).

At Step S83 subsequently, the light quantity signal SigP2 corresponding to the p-polarized light and light quantity signal SigS2 corresponding to the s-polarized light are calculated from the formulae below:

$$\mathrm{Sig}P2=Vp-Vp0$$

$$\mathrm{Sig}S2=(Vs-Vs0)/M$$

Following this, a ratio between the light quantity signals SigP2 and SigS2 corrected in the manner described above is calculated (Step S84), and a toner quantity is measured based on the calculated output ratio (=SigP2/SigS2) (Step S85).

Figure 20:
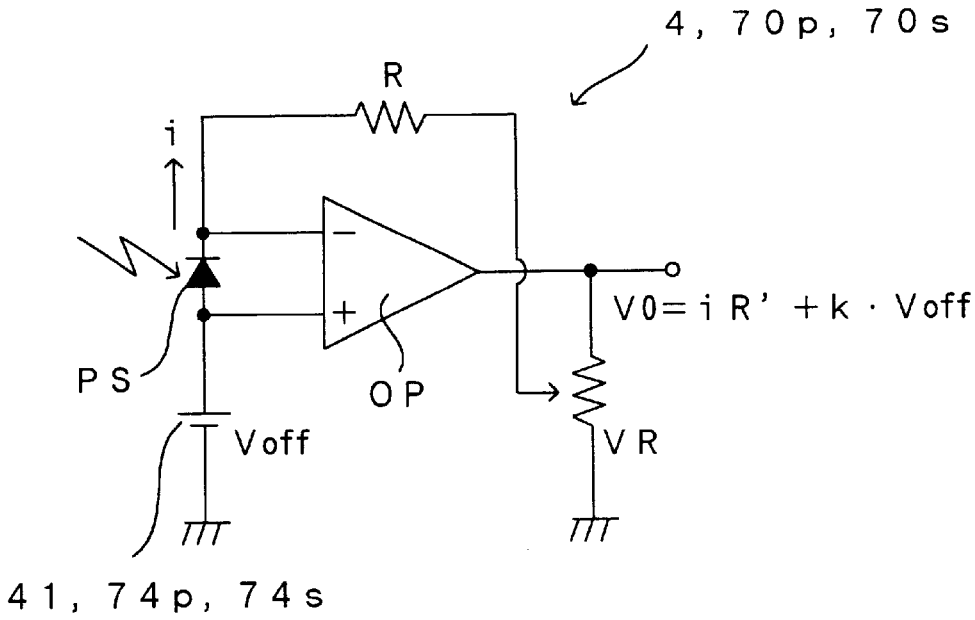
FIG. 20 is a drawing of an electric structure of another light receiving unit which can be used in the toner quantity measuring apparatus according to the present invention.
Figure 21:
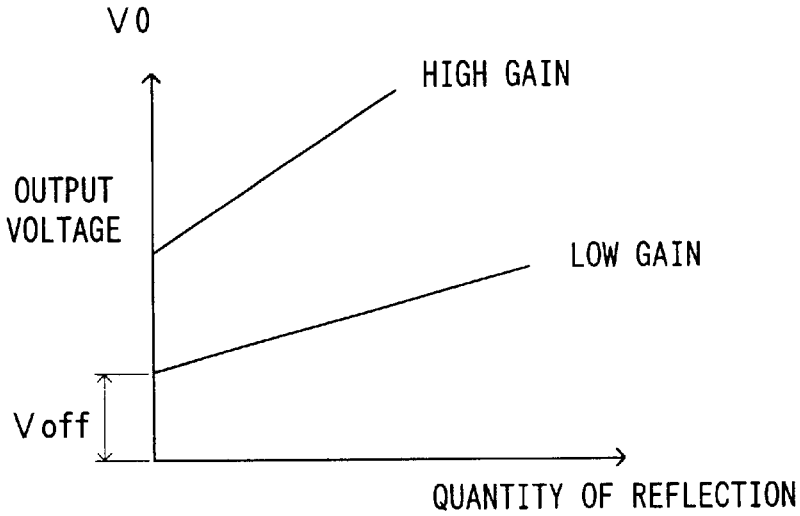
FIG. 21 is a graph showing a change in voltage outputted from the light receiving unit shown in FIG. 20 with respect to the quantity of reflected light.

The present invention is not limited to the preferred embodiments above but may be modified in a variety of ways other than those described above to the extent not departing from the spirit of the invention. For instance, according to the preferred embodiments above, the light receiving units 4, 70*p*, 70*s* have a structure as that shown in FIG. 5 and the output voltage V0 corresponding to the quantity of received light (the quantity of reflected light) is outputted from the operational amplifier OP of each one of the light receiving units 4, 70*p*, 70*s*. With a variable resistor VR interposed between the output terminal of the operational amplifier OP and the ground potential as shown in FIG. 20, the following effect is obtained. That is, in the light receiving unit shown in FIG. 20, by means of manipulation of the variable resistor VR, it is possible to change a composite resistance R' between this output terminal and the cathode terminal of the light receiving element PS (described as the elements 42, 72*p*, 72*s* in the preferred embodiments), and hence, adjust the gain. The gain adjustment makes it possible to change the characteristic of the output voltage V0 in response to the quantity of reflected light as shown in FIG. 21. Thus, as the gain of the light receiving unit is adjusted in accordance with the structure of the apparatus, a toner quantity is measured more appropriately at an even higher accuracy.

Further, in the light receiving unit shown in FIG. 20, the output voltage V0 is:

$$V0=i\cdot R'+k\cdot V\mathrm{off}$$

(where the symbol k denotes a positive feedback gain due to the operational amplifier OP and the resistor VR), and therefore, even when the quantity of reflected light is zero, the offset voltage becomes high if the gain is set high. Because of this, the output voltage in response to the quantity of the reflected light saturates in the mid- and the low-density regions, thereby reducing a measurable range narrow.

Figure 22:
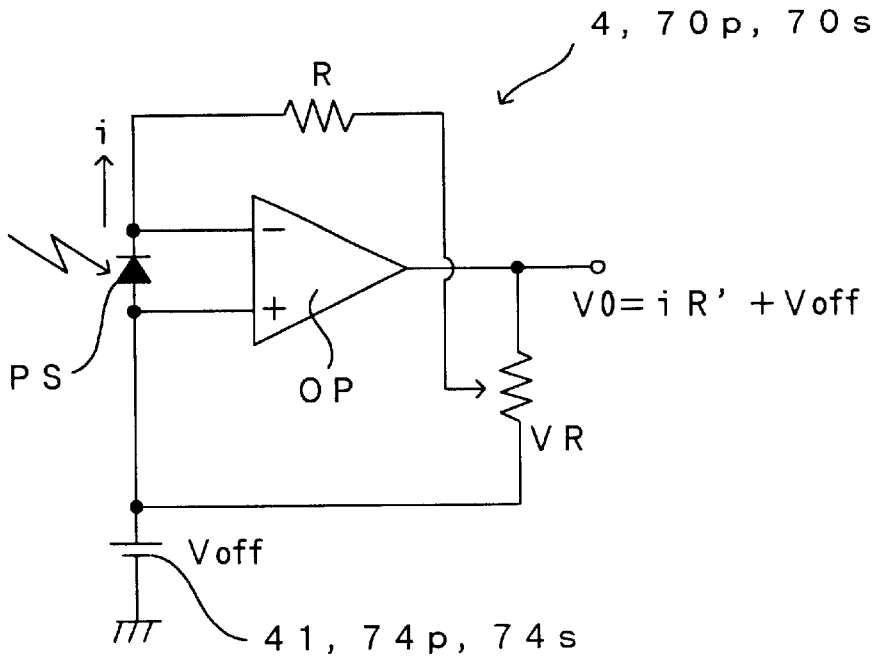
FIG. 22 is a drawing of an electric structure of still other light receiving unit which can be used in the toner quantity measuring apparatus according to the present invention.
Figure 23:
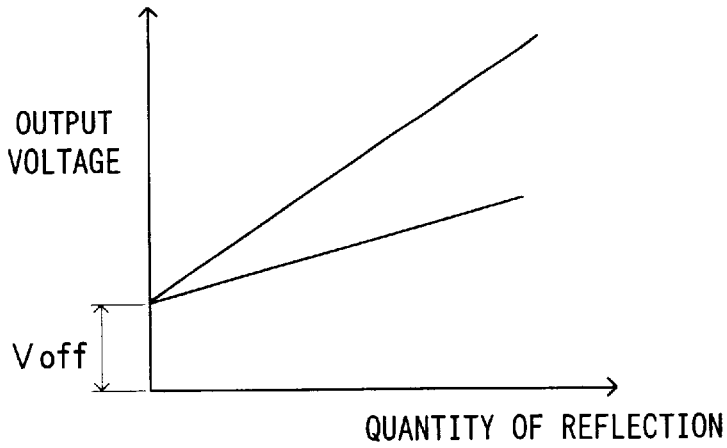
FIG. 23 is a graph showing a change in voltage outputted from the light receiving unit shown in FIG. 22 with respect to the quantity of reflected light.

A solution of this problem may be to insert a variable resistor VR between the non-inversion input terminal and the output terminal of the operational amplifier OP as shown in FIG. 22. In such a light receiving unit, since the voltage V0 at the output terminal is:

$$V0=i\cdot R'+V\mathrm{off}$$

the output voltage V0 in response to the quantity of the reflected light changes as shown in FIG. 23. In other words, the offset voltage where the quantity of the reflected light is zero is always the voltage Voff, which solves the problem described above.

Further, while the foregoing has described the preferred embodiments on the premise that s-polarized light is to be completely removed by the polarizing beam splitter 3 from irradiated light, since perfect separation is difficult in reality, irradiated light may contain s-polarized light. Even when irradiated light containing p-polarized light and s-polarized light at a ratio of 1:n (n<1) is used, it is possible to measure the quantity of toner in a similar manner to those according to the preferred embodiments above. In addition, although p-polarized light is used as light which is irradiated upon the intermediate transfer belt 141, irradiated light containing only s-polarized light or containing p-polarized light and s-polarized light at a ratio of m:1 (m<1) may be used instead.

Although the first and the third preferred embodiments and the embodiment aiming at improvement require to split reflected light into mutually different light components (p-polarized light and s-polarized light) and measure the quantity of toner based on these light components, the present invention is applicable to image forming apparatuses in general comprising a measuring apparatus such as (1) a toner quantity measuring apparatus which receives only one of a plurality of light components, e.g., p-polarized light and measures the quantity of toner based on the quantity of the p-polarized light and (2) a toner quantity measuring apparatus which receives reflected light as it is and measures the quantity of toner based on the quantity of the reflected light.

In addition, although the quantity of toner adhering on the intermediate transfer belt 141 is measured according to the preferred embodiments above, the present invention is applicable also to a toner quantity measuring apparatus which measures the quantity of toner adhering on the photosensitive member 121. In short, the present invention is applicable to toner quantity measuring apparatuses in general which measure the quantity of toner adhering on an image carrier.

Further, an image forming apparatus which can mount the toner quantity measuring apparatus according to the present invention is not limited to the apparatus which is shown in FIG. 3. The present invention is applicable to image forming apparatuses in general which create a monochrome image or a color image on an image carrier.

Although the invention has been described with reference to specific embodiments, this description is not meant to be construed in a limiting sense. Various modifications of the disclosed embodiment, as well as other embodiments of the present invention, will become apparent to persons skilled in the art upon reference to the description of the invention. It is therefore contemplated that the appended claims will cover any such modifications or embodiments as fall within the true scope of the invention.

What is claimed is:

1. A toner quantity measuring apparatus which measures a quantity of toner adhering to an image carrier, comprising:

a light emitting element which irradiates light toward said image carrier;

a light receiving element which receives light reflected by said image carrier and outputs a signal which corresponds to a quantity of received light; and toner quantity calculating means for calculating the quantity of said toner which adheres to said image carrier based on an output from said light receiving element, wherein a predetermined output offset is applied to the output from said light receiving element.

2. The toner quantity measuring apparatus of claim 1, further comprising irradiation amount adjusting means for controlling said light emitting element in accordance with a light quantity control signal supplied from said toner quantity calculating means to thereby control a quantity of light irradiated by said light emitting element, wherein said irradiation amount adjusting means keeps said light emitting element turned off while said light quantity control signal remains below a predetermined input offset.

3. The toner quantity measuring apparatus of claim 1, wherein said toner quantity calculating means comprises a memory part which temporarily stores, as dark output information, received light quantity information which is expressed by the signal which is outputted from said light receiving element when said light emitting element remains turned off, and when said light emitting element is turned on, said toner quantity calculating means subtracts said dark output information from said received light quantity information which is expressed by the signal which is outputted from said light receiving element, to thereby calculate the quantity of said toner based on a result of the subtraction.

4. An image forming apparatus, comprising:

a toner quantity measuring apparatus which measures a quantity of toner adhering to an image carrier, including a light emitting element which irradiates light toward said image carrier, a light receiving element which receives light reflected by said image carrier and outputs a signal which corresponds to a quantity of received light, and toner quantity calculating means for calculating the quantity of said toner which adheres to said image carrier based on an output from said light receiving element;

image forming means for creating a toner image on the image carrier; and control means for adjusting a process condition based on the quantity of toner which is measured by said toner quantity measuring apparatus and for controlling a density of said toner image, wherein a predetermined output offset is applied to the output from said light receiving element.

5. A toner quantity measuring apparatus which measures a quantity of toner adhering to an image carrier, comprising:

a light emitting element which irradiates light toward said image carrier;

irradiation amount adjusting means for controlling said light emitting element in accordance with a light quantity control signal which is supplied from outside to thereby control a quantity of light irradiated by said light emitting element;

a light receiving element which receives light reflected by said image carrier and outputs a signal which corresponds to a quantity of received light; and toner quantity calculating means for supplying said light quantity control signal to said irradiation amount adjusting means and for setting the quantity of said light irradiated by said light emitting element, to thereby calculate the quantity of said toner adhering to said image carrier based on an output signal from said light receiving element, wherein said irradiation amount adjusting means keeps said light emitting element turned off while said light quantity control signal from said toner quantity calculating means remains below a predetermined input offset.

6. The toner quantity measuring apparatus of claim 5, further comprising:

an irradiation-side beam splitter which splits a portion of said light irradiated by said light emitting element toward said image carrier at a predetermined rate and extracts split light; and irradiation quantity monitoring means for receiving said light extracted by said irradiation-side beam splitter and for outputting a signal which is in proportion to the quantity of said irradiated light upon said image carrier, wherein said irradiation amount adjusting means feedback-controls said light emitting element based on said light quantity control signal which is supplied from said toner quantity calculating means and the signal which is output from said irradiation quantity monitoring means with a predetermined offset applied to the signal.

7. The toner quantity measuring apparatus of claim 5, wherein said toner quantity calculating means supplies said light quantity control signal which corresponds to a density of said toner on said image carrier and accordingly adjusts the quantity of said irradiated light.

8. The toner quantity measuring apparatus of claim 7, wherein said toner quantity calculating means provides said irradiation amount adjusting means with at least two light quantity control signals which are different from each other before adjusting the quantity of said irradiated light, and identifies a light quantity control characteristic from each one of said light quantity control signals and an output from said light receiving element corresponding to each one of said light quantity control signals, and said toner quantity calculating means, for adjustment of the quantity of said irradiated light, determines which quantity control signal to supply to said irradiation amount adjusting means based on said light quantity control characteristic.

9. The toner quantity measuring apparatus of claim 5, wherein said toner quantity calculating means comprises a memory part which temporarily stores, as dark output information, received light quantity information which is expressed by the signal which is outputted from said light receiving element when said light emitting element remains turned off, and when said light emitting element is turned on, said toner quantity calculating means subtracts said dark output information from said received light quantity information which is expressed by the signal which is outputted from said light receiving element, to thereby calculate the quantity of said toner based on a result of the subtraction.

10. An image forming apparatus, comprising:

a toner quantity measuring apparatus which measures a quantity of toner adhering to an image carrier, including a light emitting element which irradiates light toward said image carrier, irradiation amount adjusting means for controlling said light emitting element in accordance with a light quantity control signal which is supplied from outside to thereby control a quantity of light irradiated by said light emitting element, a light receiving element which receives light reflected by said image carrier and outputs a signal which corresponds to a quantity of received light, and toner quantity calculating means for supplying said light quantity control signal to said irradiation amount adjusting means and for setting the quantity of said light irradiated by said light emitting element, to thereby calculate the quantity of said toner adhering to said image carrier based on an output signal from said light receiving element;

image forming means for creating a toner image on the image carrier; and control means for adjusting a process condition based on a toner quantity which is measured by said toner quantity measuring apparatus and for controlling a density of said toner image, wherein said irradiation amount adjusting means keeps said light emitting element turned off while said light quantity control signal from said toner quantity calculating means remains below a predetermined input offset.

11. A toner quantity measuring apparatus which measures a quantity of toner adhering to an image carrier, comprising:

a light emitting element which irradiates light upon said image carrier;

reflection quantity detecting means including light splitting means for splitting said reflected light from said image carrier into a first light component and a second light component, a first light receiving element which receives said first light component coming from said light splitting means and detects a light quantity of said first light component; and a second light receiving element which receives said second light component coming from said light splitting means and detects a light quantity of said second light component; and toner quantity calculating means for calculating a light quantity ratio between the light quantity of said first light component and the light quantity of said second light component which are detected by said reflection quantity detecting means, and for calculating the quantity of toner adhering on said image carrier based on said light quantity ratio, wherein when a dynamic range of a second output signal from said second light receiving element is smaller than a dynamic range of a first output signal from said first light receiving element, said second output signal is amplified at a higher amplification rate than an amplification rate for said first output signal.

12. A toner quantity measuring apparatus, which measures a quantity of toner adhering to an image carrier, comprising:

a light emitting element which irradiates light upon said image carrier;

reflection quantity detecting means for detecting light quantities of a first and a second light components which are different from each other and contained in reflected light from said image carrier; and toner quantity calculating means for calculating a light quantity ratio between a light quantity of said first light component and a light quantity of said second light component which are detected by said reflection quantity detecting means, and for calculating the quantity of toner adhering on said image carrier based on said light quantity ratio, wherein said light emitting element controls a quantity of said irradiated light upon said image carrier in accordance with a light quantity control signal which is supplied from said toner quantity calculating means, and said toner quantity calculating means provides said light emitting element with a light quantity control signal which corresponds to a density of said toner on said image carrier and accordingly adjusts the quantity of said irradiated light.

13. The toner quantity measuring apparatus of claim 12, wherein said toner quantity calculating means provides said light emitting element with two light quantity control signals one after another which are different from each other before adjusting the quantity of said irradiated light, and derives a light quantity control characteristic from each one of said light quantity control signals and an output from said reflection quantity detecting means corresponding to each one of said light quantity control signals, and said toner quantity calculating means, for adjustment of the quantity of said irradiated light, determines which quantity control signal to supply to said light emitting element based on said light quantity control characteristic.

14. A toner quantity measuring apparatus which detects a quantity of toner adhering on an image carrier, comprising:

a light emitting element which irradiates light upon said image carrier;

reflection quantity detecting means for detecting light quantities of a first and a second light components which are different from each other and contained in reflected light from said image carrier; and toner quantity calculating means for executing, as a measurement process of measuring a toner quantity, a plurality of toner quantity detection processes which are different from each other, and for selectively executing one of said plurality of toner quantity detection processes in accordance with a color of the toner adhering on said image carrier.

15. The toner quantity measuring apparatus of claim 14, wherein a dynamic range of a first light quantity signal, which is outputted from said reflection quantity detecting means as a signal which is indicative of a light quantity of said first light component, is larger than a dynamic range of a second light quantity signal which is outputted from said reflection quantity detecting means as a signal which is indicative of a light quantity of said second light component, said toner quantity calculating means calculates a quantity of black toner based on only the light quantity of said first light component if said toner to be measured is black toner, and if said toner to be measured is a toner other than black toner, said toner quantity calculating means calculates a light quantity ratio between the light quantity of said first light component and the light quantity of said second light component and identifies the quantity of said toner adhering on said image carrier based on said light quantity ratio.

16. The toner quantity measuring apparatus of claim 15, wherein said light emitting element changes a quantity of irradiated light upon said image carrier, and said toner quantity calculating means, if said toner to be measured is black toner, controls said light emitting element such that said light emitting element irradiates light upon said image carrier in a larger irradiation quantity than when said toner to be measured is the toner other than black toner.

17. The toner quantity measuring apparatus of claim 14, wherein said reflection quantity detecting means comprises:

light splitting means for splitting said reflected light from said image carrier into said first light component and said second light component;

a first light receiving element which receives said first light component coming from said light splitting means and detects the light quantity of said first light component; and a second light receiving element which receives said second light component coming from said light splitting means and detects the light quantity of said second light component, wherein when a dynamic range of a second output signal from said second light receiving element is smaller than a dynamic range of a first output signal from said first light receiving element, said second output signal is amplified at a higher amplification rate than an amplification rate for said first output signal.

18. The toner quantity measuring apparatus of claim 17, wherein said light emitting element controls a quantity of said irradiated light upon said image carrier in accordance with a light quantity control signal which is supplied from said toner quantity calculating means, and said toner quantity calculating means provides said light emitting element with a light quantity control signal which corresponds to a density of said toner on said image carrier and accordingly adjusts the quantity of said irradiated light.

19. The toner quantity measuring apparatus of claim 18, wherein said toner quantity calculating means provides with said light emitting element with two light quantity control signals one after another which are different from each other before adjusting the quantity of said irradiated light, and derives a light quantity control characteristic from each one of said light quantity control signals and an output from said reflection quantity detecting means corresponding to each one of said light quantity control signals, and said toner quantity calculating means, for adjustment of the quantity of said irradiated light, determines which quantity control signal to supply to said light emitting means based on said light quantity control characteristic.

20. The toner quantity measuring apparatus of claim 14, wherein said toner quantity calculating means calculates a quantity of black toner based on only the light quantity of said first light component if said toner to be measured is black toner, and if said toner to be measured is a toner other than black toner, said toner calculating means calculates the quantity of said toner adhering on said image carrier based on the light quantity of said first light component and the light quantity of said second light component.

21. An image forming apparatus, comprising:

a toner quantity measuring apparatus which measures a quantity of toner adhering to an image carrier, including a light emitting element which irradiates light upon said image carrier, reflection quantity detecting means for detecting light quantities of a first and a second light components which are different from each other and contained in reflected light from said image carrier, and toner quantity calculating means for executing, as a measurement process of measuring a toner quantity, a plurality of toner quantity detection processes which are different from each other, and for selectively executing one of said plurality of toner quantity detection processes in accordance with a color of toner adhering on said image carrier;

image forming means for creating a toner image on the image carrier; and toner quantity calculating means for adjusting a process condition based on the toner quantity which is measured by said toner quantity measuring apparatus and for controlling a density of said toner image.

* * * * *